US009603436B2

(12) United States Patent
Miyamoto

(10) Patent No.: US 9,603,436 B2
(45) Date of Patent: Mar. 28, 2017

(54) APPLICATOR

(71) Applicant: MITSUBISHI PENCIL COMPANY, LIMITED, Tokyo (JP)

(72) Inventor: Kohei Miyamoto, Fujioka (JP)

(73) Assignee: MITSUBISHI PENCIL COMPANY, LIMITED, Tokyo (JP)

( * ) Notice: Subject to any disclaimer, the term of this patent is extended or adjusted under 35 U.S.C. 154(b) by 0 days.

(21) Appl. No.: 14/736,879

(22) Filed: Jun. 11, 2015

(65) Prior Publication Data

US 2015/0359316 A1 Dec. 17, 2015

(30) Foreign Application Priority Data

Jun. 13, 2014 (JP) ..... 2014-121988

(51) Int. Cl.

| | |
|---|---|
| ***A45D 40/26*** | (2006.01) |
| ***A45D 34/04*** | (2006.01) |
| *A45D 40/00* | (2006.01) |
| *B05C 17/01* | (2006.01) |

(52) U.S. Cl.

CPC ..... *A45D 40/26* (2013.01); *A45D 34/04* (2013.01); *A45D 2040/0012* (2013.01); *A45D 2200/056* (2013.01); *B05C 17/0133* (2013.01)

(58) Field of Classification Search

CPC combination set(s) only.
See application file for complete search history.

(56) References Cited

U.S. PATENT DOCUMENTS

| | | | | |
|---|---|---|---|---|
| 2,283,463 | A * | 5/1942 | Rupp | B65D 35/36 222/494 |
| 4,461,408 | A * | 7/1984 | Shepard | B65D 47/248 222/501 |
| 5,454,660 | A * | 10/1995 | Sakurai | A45D 34/042 401/174 |
| 7,108,442 | B2 * | 9/2006 | DuFour | A45D 34/042 222/494 |
| 7,168,878 | B2 | 1/2007 | Tani | |
| 7,891,899 | B2 | 2/2011 | Tani | |
| 2005/0063768 | A1 | 3/2005 | Tani | |
| 2007/0020038 | A1 | 1/2007 | Tani | |
| 2013/0343801 | A1 | 12/2013 | Sakuma et al. | |

FOREIGN PATENT DOCUMENTS

| | | |
|---|---|---|
| JP | 6-22816 A | 2/1994 |
| JP | 2005-87562 A | 4/2005 |
| JP | 2012-135465 A | 7/2012 |
| JP | 2014-4084 A | 1/2014 |

* cited by examiner

*Primary Examiner* — David Walczak
(74) *Attorney, Agent, or Firm* — Birch, Stewart, Kolasch & Birch, LLP

(57) ABSTRACT

An applicator for delivering an application liquid fed from a reservoir, from a delivery port to an outside by way of an interior space of an application body, includes a spacer inserted in the interior space of the application body. In this applicator, a clearance between an exterior face of the spacer and an interior face of the application body forms a communication passage for flowing the application liquid, and the application liquid is delivered from the delivery port by way of the communication passage.

13 Claims, 42 Drawing Sheets

APPLICATOR

This Nonprovisional application claims priority under 35 U.S.C. §119 (a) on Patent Application No. 2014-121988 filed in Japan on 13 Jun. 2014, the entire contents of which are hereby incorporated by reference.

BACKGROUND OF THE INVENTION (1) Field of the Invention

The present invention relates to applicators for applying application liquids such as liquid rouge, liquid foundation, creamy makeup and the like.

(2) Description of the Prior Art

In general, the applicators for applying application liquids such as liquid cosmetics and the like are constructed such that the application liquid is pushed out from a reservoir disposed in the barrel to the delivery port of the application body arranged at a barrel front and can be applied to an object such as the skin and the like.

Since the application body, especially when used for cosmetics, is demanded to present a suitable contact feeling to be applied to the skin, the application body is generally formed of resin.

In the applicator of this kind, when the application body is formed as a thick-walled molding, there may occur the problem of sink marks appearing in the application body due to shrinkage after molding. Sink marks appear as unwanted thin-walled areas and voids, causing production defects, hence are wanted to be prevented.

Also, in order to stabilize forming of the application body, provision of reduced thickness parts can be considered.

When a hollow application body is used, use of a container including a pressurizing and extruding mechanism using a piston or the like can be considered. The present applicator has proposed a Patent Document 1 as a liquid applicator of this type.

However, in the liquid applicator with a hollow application body of this kind, there occur cases where the liquid is left over inside the application body without being able to squeeze out the last drops of liquid.

As a measure to prevent the liquid from being left over, there has been a known configuration (see Patent Document 2) in which a communication passage for leading the application liquid into the application body is made thin. However, in this case, the communication passage becomes long and narrow, there is a risk of the liquid clogging in the communication passage if the application liquid dries up due to cases such that non-use period of the applicator becomes long.

As another measure for prevention against liquid residue, there has been proposals of providing a spacer inside the interior space of the application body (see Patent Documents 3 and 4). However, the conventional spacer configuration still entails the risk of the liquid being left over after the piston reaches the advance limit.

Further, in the case where a spacer is used, there occurs the problem that the spacer becomes conspicuous, spoiling design performance of the applicator if the application body is formed of a transparent material.

Moreover, because the liquid flows through the center of the spacer in the conventional configuration, the joint between the application body and the spacer is required to complicated.

PRIOR ART DOCUMENTS

Patent Documents

Patent Document 1:
Japanese Patent Application Laid-open 2012-135465
Patent Document 2:
Japanese Patent Application Laid-open 2014-4084
Patent Document 3:
Japanese Patent Application Laid-open H06-22816
Patent Document 4:
Japanese Patent Application Laid-open 2005-87562

SUMMARY OF THE INVENTION

Under the above circumstance, the present invention is to provide an applicator that can cut down the volume of the space inside the application body and suppress the residual liquid by providing a spacer inside the application body and that is not required to be hermetic at the joint between the application body and the spacer.

The first aspect of the present invention resides in an applicator for delivering an application liquid from a delivery port to an outside by way of an interior space of an application body, comprising:

an application body; and, a spacer inserted in an interior space of the application body, wherein a clearance between an exterior face of the spacer and an interior face of the application body forms a communication passage for flowing an application liquid, and the application liquid is delivered from a delivery port of the application body by way of the communication passage.

The second aspect of the present invention is characterized in that a projected area is formed in a vicinity of the delivery port on one of the exterior face of the spacer and the interior face of the application body, facing the clearance, and the clearance in the vicinity of the delivery port is made narrower than the clearance in the other area than the vicinity of the delivery port.

The third aspect of the present invention is characterized in that the application body is formed to be transparent or translucent so as to make the application liquid in the interior space visible.

The fourth aspect of the present invention is characterized in that the spacer is formed with a communication hole for connecting the clearance with an application liquid supply side.

The fifth aspect of the present invention is characterized in that an indentation is formed in one of a rear end of the spacer and a rear end of the application body while a projection is formed in the other thereof so that the projection and the indentation are engaged to assure anti-rotation.

Advantages of the Invention

According to the applicators of the present invention, the volume of the interior space of the application body can be cut down by providing the spacer inside the application body. Since the application liquid is flowed through the clearance between the application body and the spacer, it is possible to suppress the residual liquid on the spacer. Further, since the application liquid is flowed inside the application body, hermeticity is not demanded for the joint between the application body and the spacer.

Herein, depending on the position of the delivery port in the application body there is a risk that liquid unfilled part is formed in the clearance between the application body and the spacer, spoiling the external appearance due to generation of air bubbles. To deal with this, for the clearance in the vicinity of the delivery port, the projected area is formed on one of the spacer's exterior face and the application body's interior face, which are facing the clearance, so as to make the clearance in the vicinity of the delivery port narrower than the clearance in the other area than the vicinity of the delivery port. By this arrangement, it is possible to delay ejection of the application liquid by the flow resistance of the application liquid arising from the narrowed clearance, whereby the application liquid can be fully or completely spread inside the application body, without generating air bubbles. Filling the interior of the application body with the application liquid makes it possible to achieve ejection of the application liquid without degrading the exterior appearance of the application body due to remaining air bubbles.

In this case, forming the application body to be transparent or translucent to make the interior application liquid visible, produces excellent advantage that the interior of the application body can be externally observed and fully confirmed.

Figure 19C:
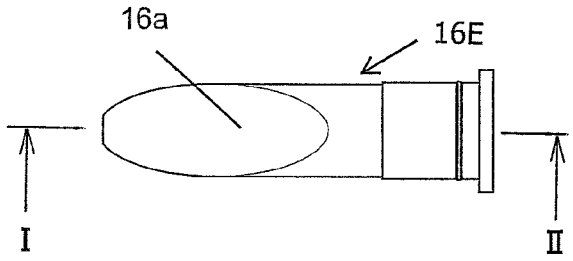
FIG. 19*c* is a plan view of the spacer 16E, viewed from the slope side.
Figure 19A:
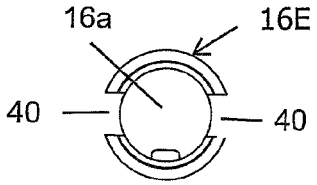
FIG. 19*a* is a view of a spacer 16E used for the applicator according to the embodiment of the present invention, viewed from the front.
Figure 19D:
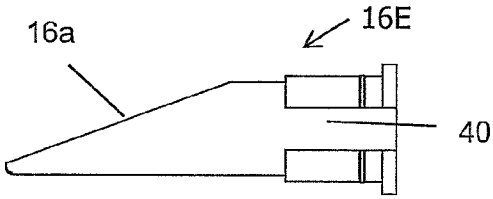
FIG. 19*d* is a side view of the spacer 16E.
Figure 19B:
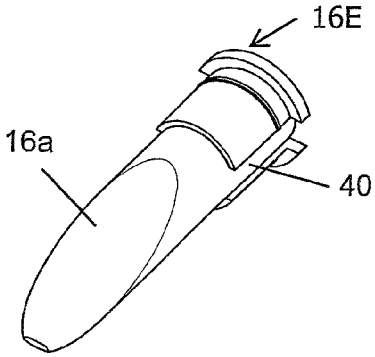
FIG. 19*b* is a perspective view of the spacer 16E, viewed from the front.
Figure 19E:
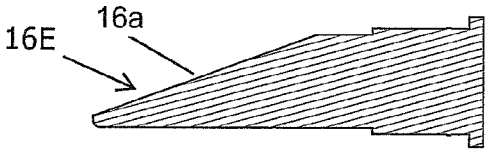
FIG. 19*e* is a sectional view, cut along a line I-II in FIG. 19*c;*
Figure 19F:
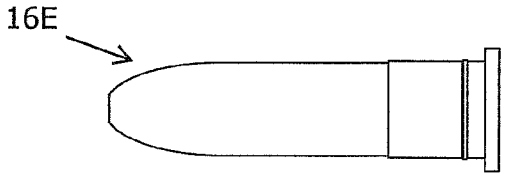
FIG. 19*f* is a backside view of the spacer 16E.
Figure 19G:
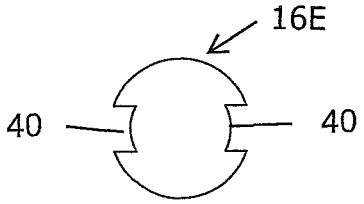
FIG. 19*g* is a view of the spacer 16E, viewed from the rear.
Figure 19H:
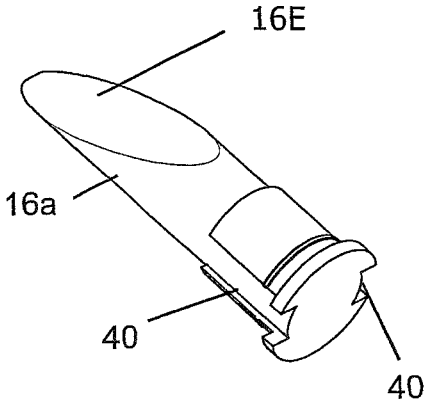
Figure 20C:
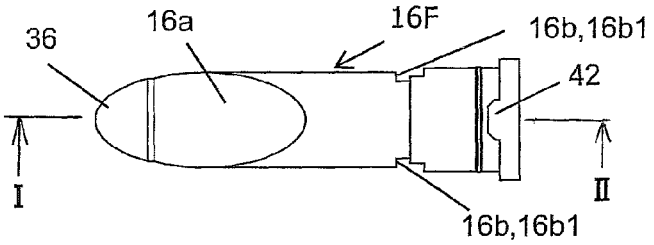
Figure 20A:
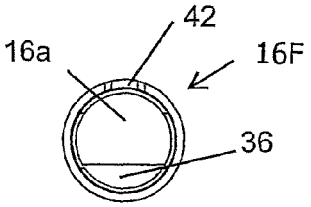
Figure 20D:
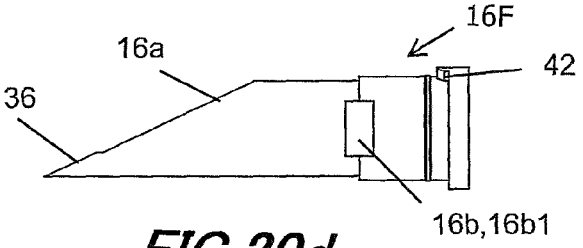
Figure 20B:
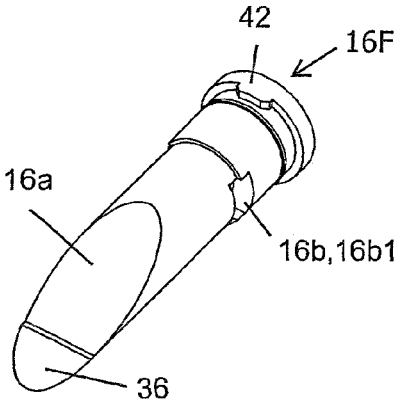
Figure 20E:
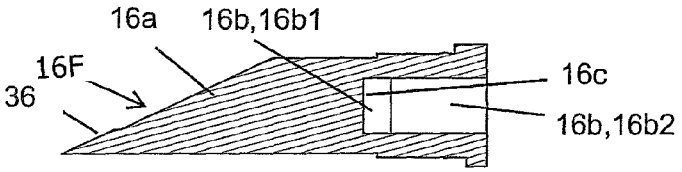

FIG. 19*h* is a perspective view of the spacer 16E, viewed from the rear;

FIG. 20*a* is a view of a spacer 16F used for the applicator according to the embodiment of the present invention, viewed from the front;

FIG. 20*b* is a perspective view of the spacer 16F, viewed from the front;

FIG. 20*c* is a plan view of the spacer 16F, viewed from the slope side;

FIG. 20*d* is a side view of the spacer 16F;

FIG. 20*e* is a sectional view, cut along a line I-II in FIG. 20*c;*

Figure 20F:
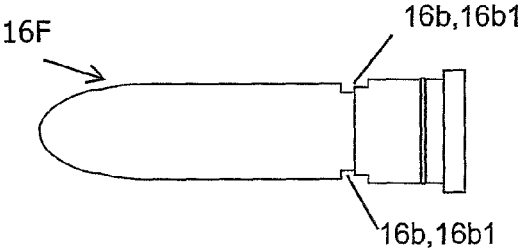
Figure 20G:
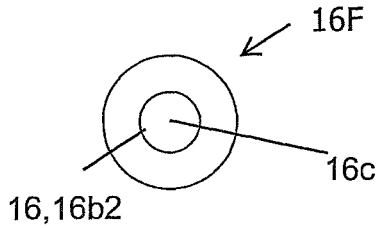
Figure 20H:
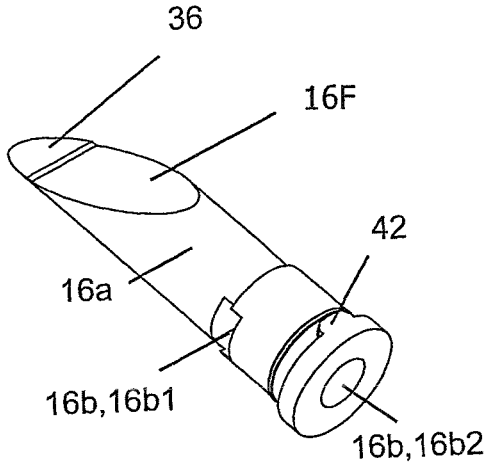
Figure 21C:
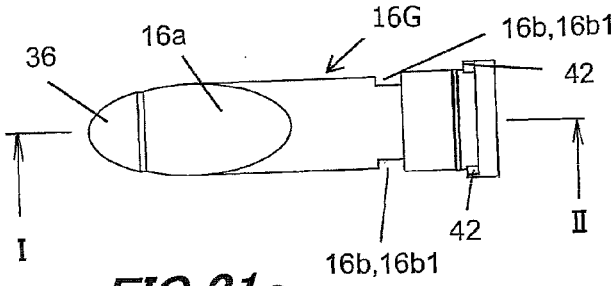
Figure 21A:
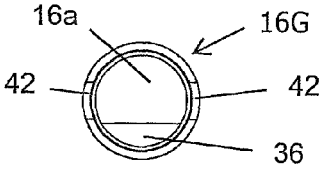
Figure 21D:
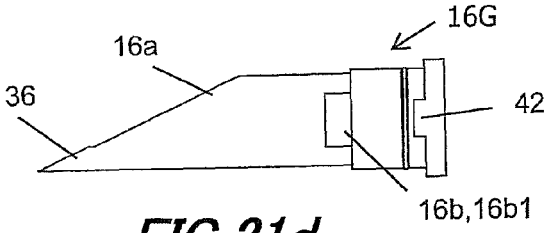
Figure 21B:
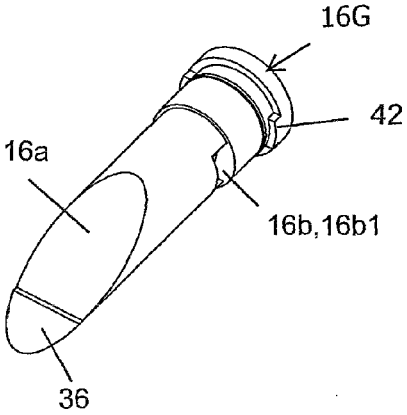
Figure 21E:
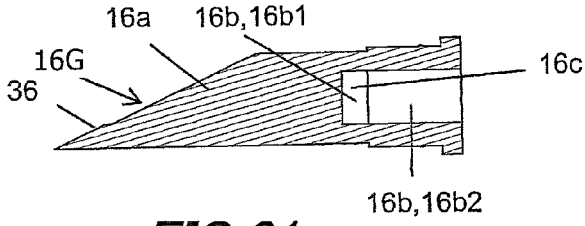

FIG. 20*f* is a backside view of the spacer 16F;

FIG. 20*g* is a view of the spacer 16F, viewed from the rear;

FIG. 20*h* is a perspective view of the spacer 16F, viewed from the rear;

FIG. 21*a* is a view of a spacer 16G used for the applicator according to the embodiment of the present invention, viewed from the front;

FIG. 21*b* is a perspective view of the spacer 16G, viewed from the front;

FIG. 21*c* is a plan view of the spacer 16G, viewed from the slope side;

FIG. 21*d* is a side view of the spacer 16G;

FIG. 21*e* is a sectional view, cut along a line I-II in FIG. 21*c;*

Figure 21F:
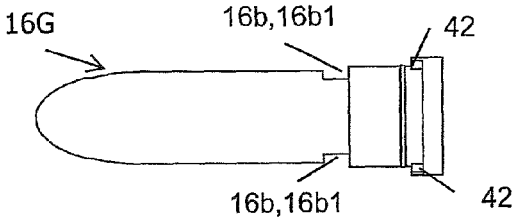
Figure 21G:
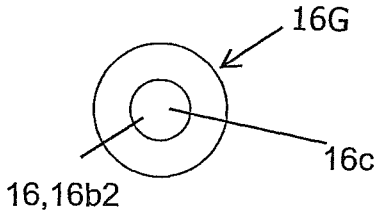
Figure 21H:
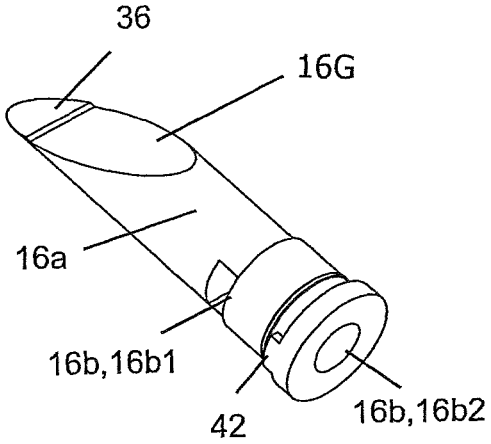

FIG. 21*f* is a backside view of the spacer 16G;

FIG. 21*g* is a view of the spacer 16G, viewed from the rear; and,

FIG. 21*h* is a perspective view of the spacer 16G, viewed from the rear.

REFERRED EMBODIMENTS

The embodiments of the present invention will hereinafter be described with reference to the accompanying drawings.

FIGS. 1*a* to 10*e* show applicators according to embodiments 1 to 10 of the present invention. FIGS. 11*a* to 14*h* are part drawings respectively showing application bodies 14A to 14D in the embodiments of the application body 14 (FIGS. 1*a* to 10*e*). FIGS. 15*a* to 21*h* are part drawings respectively showing spacers 16A to 16G in the embodiments of the spacer 16 (FIGS. 1*a* to 10*e*).

Here, in the following description, FIGS. 1*a* to 1*e*, FIGS. 2*a* to 2*e*, FIGS. 3*a* to 3*e*, FIGS. 4*a* to 4*e*, FIGS. 5*a* to 5*e*, FIGS. 6*a* to 6*e*, FIGS. 7*a* to 7*e*, FIGS. 8*a* to 8*e*, FIGS. 9*a* to 9*e* and FIGS. 10*a* to 10*e* may be also be generally referred to as FIG. 1, FIG. 2, FIG. 3, FIG. 4, FIG. 5, FIG. 6, FIG. 7, FIG. 8, FIG. 9 and FIG. 10, respectively.

Similarly, FIGS. 11*a* to 11*h*, FIGS. 12*a* to 12*h*, FIGS. 13*a* to 13*h*, FIGS. 14*a* to 14*h*, FIGS. 15*a* to 15*h*, FIGS. 16*a* to 16*h*, FIGS. 17*a* to 17*h*, FIGS. 18*a* to 18*h*, FIGS. 19*a* to 19*h*, FIGS. 20*a* to 20*h*, and FIGS. 21*a* to 21*h* may also be generally referred to as FIG. 11, FIG. 12, FIG. 13, FIG. 14, FIG. 15, FIG. 16, FIG. 17, FIG. 18, FIG. 19, FIG. 20 and FIG. 21, respectively.

As shown in FIGS. 1 to 10, any of the applicators according to embodiments 1 to 10 is configured so that the application liquid stored in a source of liquid comprising reservoir space 20 in a barrel main body 10 is supplied to an application body 14 formed of an elastic material at the front end of the main body 10 by a liquid pressurizing mechanism 12 attached to the main body 10 while the application body 14 is abutted against an object to apply the application liquid to the object.

Detailedly, the applicator includes the main body 10, the application body 14, the spacer 16, the application liquid reservoir space 20 for storing the application liquid and the liquid pressurizing mechanism 12. Though the applicators of FIGS. 1 to 10 can be attached with a removable cap (not shown), the state with the cap removed is shown.

The main body 10 has an approximately cylindrical shape narrowed in the front end where a main body small-diametric part 10*a* is formed. An unillustrated cap can be removably fitted to the main body small-diametric part 10*a*. The space enclosed by the spacer 16 and a piston body 22 inside the main body 10 forms the application liquid reservoir space 20. As the piston body 22 is advanced in the main body 10 by the liquid pressurizing mechanism 12, the volume of this application liquid reservoir space 20 is decreased so as to pressurize the application liquid and send out the application liquid toward the application body 14.

The liquid pressurizing mechanism 12 includes the piston body 22 and a drive mechanism (formed of a rotational actuator 30, an axis-like member 24, a threaded part 26, an advancing element 28 and the like).

The piston body 22 is configured to move forward and backward relative to the application liquid reservoir space 20 inside the main body 10 to decrease and increase the volume of the reservoir space.

The drive mechanism (formed of the rotational actuator 30, the axis-like member 24, the threaded part 26, the advancing element 28 and the like) has the front part of the axis-like member (also referred to as threaded rod) 24 engaged with the rear part of the piston body 22 and moves this axis-like member 24 forward and backward to advance and retract the piston body 22 as the user applies operational force.

The rotational actuator 30 is a cylindrical handle that is fitted in an unrotatable manner on the rear end part of the advancing element 28. The front end of the advancing element 28 is fitted into the rear end of the main body 10. The center in the front end of the advancing element 28 is formed with a variant-shaped hole (the aftermentioned cam shape), into which the axis-like member 24 (having a contour of the variant-shaped cam shape) is inserted. The axis-like member 24 is fitted so as to be movable in the axial direction and unrotatable relative to advancing element 28.

The annular threaded part 26 having two cup-like forms on front and rear ends is arranged in an unrotatable manner in main body 10. The front part of the advancing element 28 is inserted into the cut-like space formed on the rear side in the threaded part 26. A meshing portion between the inner periphery of the threaded part 26 in the front part and the outer periphery of the advancing element 28 is formed with a toothed ratchet 28*a*, which limits rotation of the advancing element 28 (rotational actuator 30) or permits the advancing element to turn in one direction only relative to the threaded part 26. When the applicator is provided with a pressurizing and depressurizing mechanism, the advancing element is not restricted on rotation but is adapted to be rotatable in both directions with a clicking sensation.

The male thread on the outer periphery of the axis-like member 24 are screw fitted with the female thread formed in the center bore of the threaded part 26.

The cross section of the axis-like member 24 has a variant cam shape while the center bore of the engaging portion of the advancing element 28 as a part of the rotational actuator is formed with the variant cam shape corresponding to the outer periphery of the axis-like member 24. The axis-like member 24 is inserted into the center bore of the engaging portion and engaged with the advancing element 28 so as to be slidable in the axial direction and unrotatable relative to the advancing element 28.

The front end part of the axis-like member 24 is coupled to the piston body 22. As the rotational actuator 30 is turned in the predetermined direction, the axis-like member 24 advances the piston body 22 toward the front end of the main body 10 via the threaded part 26 to pressurize the application liquid in the application liquid reservoir space 20 of the main body 10 and send the liquid to the application body 14.

Here in the applicators of the embodiments 1 to 10, the application body 14 has the spacer 16 inserted in the interior space thereof. The spacer 16 is attached forming a clearance 32 between the interior face 14*a* of the application body 14 and the exterior face 16*a* of the spacer 16. Formed at the front end part of the application body 14 is a delivery port 14*b* that penetrates from the inside to the outside to deliver the application liquid out from within.

The front part of the external face of the application body 14 is formed with a sloping exterior surface, inclined about 20° to 45° relative to the axis. This sloping surface mainly forms an applying face 14*c*.

The rear cylindrical portion of the application body 14 is fitted into the main body small-diametric portion 10*a* in the front end of the main body 10. The application body 14 and the main body are joined so as not to slip off from each other with fitting and engagement between indentations and projections formed on the outer periphery of the cylindrical portion of the application body 14 and the inner periphery of the main body small diametric portion 10*a*.

An O-ring 18 as a sealing member is interposed between the outer periphery of the application body 14 and the inner periphery of the main body small diametric portion 10*a*, so that the application liquid pressed and sent out by the liquid pressurizing mechanism 12 will not leak.

The clearance 32 between the exterior face 16*a* of the spacer 16 and the interior face 14*a* of the application body 14 serves as a communication channel, through which the application liquid is ejected from the delivery port 14*b*.

Provision of the spacer 16 inside the application body 14 can cut down the volume of the interior space of the application body 14. Accordingly, it is possible to suppress the residual liquid in the application body 14.

Passage of the application liquid through the clearance 32 between the application body 14 and the spacer 16 assures design performance before use by virtue of the flow-out of the application liquid such as ink or the like and can suppress liquid residue in the application body 14 after use.

In the application bodies 14 according to the embodiments 1 to 4 and 8 to 10, an application body-side projected area 34 or a spacer-side projected area 36, which is projected one step higher from the interior face (inner wall) of the application body 14 or the exterior face (outer surface) of the spacer 16, is formed in the vicinity of the deliver port 14*b* (delivery port 14*b* and therearound).

As a result, the clearance (second clearance) between the interior face (inner wall) of the application body 14 and the opposite spacer-side projected area 36 is formed smaller than the clearance 32 (first clearance) between the interior face (inner wall) of the application body 14 and the opposite exterior face of the spacer 16 (other than the spacer-side projected area 36).

Similarly, the clearance 32*b* (second clearance) between the application body-side projected area 34 and the opposite exterior face of spacer 16 is formed smaller than the clearance 32 (first clearance) between the interior face (other than the application body-side projected area 34) of the application body 14 and the opposite exterior face of the spacer 16.

In the above case, the spacer-side projected area 36 is formed in the area opposite to the delivery port 14*b* and its surrounding, for easy forming. However, this may formed in the area opposite to only the surrounding area of the delivery port 14*b* only.

Further, in the application bodies 14 according to the embodiments 1 to 4 and 8 to 10, formation of either the application body-side projected area 34 or the spacer-side projected area 36 alone is exemplified. However, both the application body-side projected area 34 and the spacer-side projected area 36 may be formed.

The application body 14 is formed of transparent or translucent resin that makes the interior application liquid visible.

Specifically, the application body 14 may be formed of a resin material capable of achieving the necessary performance for application, in particular, highly transparent, silicone resin, acrylic resin, polyester resin or the like, formed by LIM molding, injection molding or others.

Preferable examples of the application liquid include various cosmetics. Also, preferable examples of the application liquid include liquid chemicals. Some of them may contain silicone oil.

The material of the application body 14 is usually selected taking into account the compatibility with the application liquid. Other than this, diverse evaluation items such as hardness, surface conditions, transparency and the like are considered for selection.

Accordingly, the application liquid in the embodiments employs liquid containing silicone oil on the assumption that a typical highly transparent resin such as acrylic resin or the like is used for the application body 14.

Depending on the position of the delivery port 14*b* in the application body 14, there is a risk that unfilled part with the application liquid is formed in the clearance 32 between the application body 14 and the spacer 16, hence spoiling the external appearance due to generation of air bubbles.

In order to prevent such generation of air bubbles, the distance between the inner wall around the delivery port 14*b* and the outer surface of the spacer 16 is made closer than the distance between the inner wall other than the vicinity (the surrounding area) of the delivery port 14*b* and the outer surface of the spacer 16, by forming a step such as a swelled portion or other projection (the step formed by application body-side projected area 34 or spacer-side projected area 36). That is, the clearance 32*b* (second clearance) in the vicinity (surrounding portion) of delivery port 14*b* is made narrower compared to the clearance 32 (first clearance) in the area other than the vicinity (surrounding portion) of the delivery port 14*b*.

Narrowing the clearance 32 in the vicinity (surrounding portion) of the delivery port 14*b* causes delay of ejection due to flow resistance of the liquid, thus making it possible to fill the whole clearance 32 with between the spacer 16 (exterior face 16*a*) inside the application body 14, with the application liquid. The application liquid can be made to uniformly fill the interior of the application body 14 so that it is possible to achieve ejection of the liquid with improved appearances, without degrading the exterior appearance of the application body 14 due to remaining air bubbles.

In particular, when the application body 14 is transparent or translucent, the flow condition of the application liquid inside the application body 14 can be well observed through the application body 14, and when the application liquid is a fluid cosmetic for makeup, the user will look at the application body when the user puts the applicator on the skin. If the user is able to confirm uniform filling of the interior of the application body 14 with the application liquid, the user can expect continuous delivery of the cosmetic without any breaks, hence apply make-up comfortably and feel at easy from the comfort.

In order to establish connection between the clearance 32 and the application liquid reservoir space 20 side, the spacer 16 is formed with a communication hole 16*b* (communication hole 16*b*1 on the front side, communication hole 16*b*2 on the rear side, wall-shaped step 16*c*) and/or a communication groove 40 (see FIG. 19).

A projection 42 (FIGS. 20*a* to 20*d* and 20*h*) is formed at the rear end of the spacer 16 while an indentation is formed at the rear end of the application body 14 so as to achieve anti-rotation by means of engagement between the projection 42 and the indentation. As another configuration, the indentation may be formed in the spacer while the projection may be formed in the application body. The projection and indentation may be modified with appropriate shape of indentations and projections.

Examples of the application body 14 include application bodies 14A to 14D shown in FIGS. 11 to 14. Examples of the spacer 16 include spacers 16A to 16G shown in FIGS. 15 to 21. Embodiments 1 to 10 shown in FIGS. 1 to 10 each use a combination of application body 14 and spacer 16 shown in Table 1 below.

TABLE 1

| | Combination | | | |
|---|---|---|---|---|
| | Application Body 14A | Application Body 14B | Application Body 14C | Application Body 14D |
| Spacer 16A | Embodiment 1 | | | |
| Spacer 16B | Embodiment 2 | | | |
| Spacer 16C | Embodiment 5 | Embodiment 3 | | |
| Spacer 16D | Embodiment 6 | Embodiment 4 | | |
| Spacer 16E | Embodiment 7 | Embodiment 8 | | |
| Spacer 16F | | | Embodiment 9 | |
| Spacer 16G | | | | Embodiment 10 |

Next, examples of the application body 14, application bodies 14A to 14D will be described.

Application bodies 14A to 14D each have a configuration as in Table 2 below.

TABLE 2

| | Application Body Configuration | |
|---|---|---|
| | Step | Anti-rotation |
| Application Body 14A | None | None |
| Application Body 14B | Formed | None |
| Application Body 14C | None | 1 place |
| Application Body 14D | None | 2 places |

All the application bodies 14A to 14D each have an approximately bag-like configuration in which the front end other than the delivery port 14*b* is closed while the rear end is cylindrically opened.

In the application body 14A, as shown in FIG. 11, an applying face 14*c* is roughly a slope inclined to the axis and formed to have a slightly arced swelling surface with a delivery port 14*b* perforated at the front end of the applying face 14*c*. Of the inner surface of application body 14A or the application body interior face 14*a* (FIG. 11*e*), the interior side of the applying face 14*c* is formed flat.

On the other hand, of the application body interior face 14*a*, the interior front end face, designated at 14*a*1 (FIGS. 11*e* and 11*g*) under the delivery port 14*b* (located on the front side of the delivery port 14*b* in the application body 14A), is formed with a predetermined curvature forming an arc.

As shown in FIG. 12, the application body 14B has an applying face 14*c* of a swelling slope similar to that of the application body 14A with a delivery port 14*b* perforated at the front end of the applying face 14*c*.

Figure 1B:
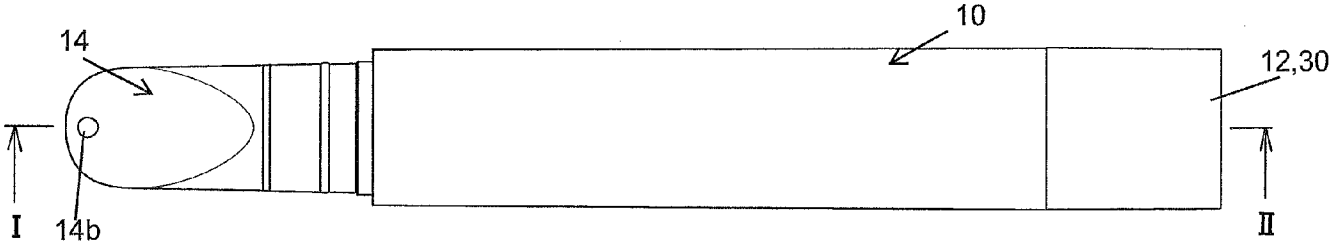
FIG. 1*b* is a plan view of the applicator according to the embodiment 1 of the present invention, viewed from the application body's slope side.
Figure 1C:
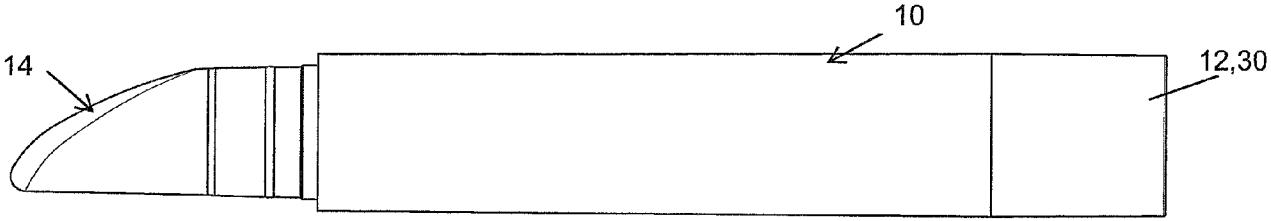
FIG. 1*c* is a side view of the applicator according to the embodiment 1 of the present invention.
Figure 1A:
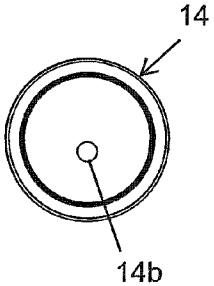
FIG. 1*a* is a view of an applicator according to the embodiment 1 of the present invention, viewed from the front of the applicator.
Figure 1D:
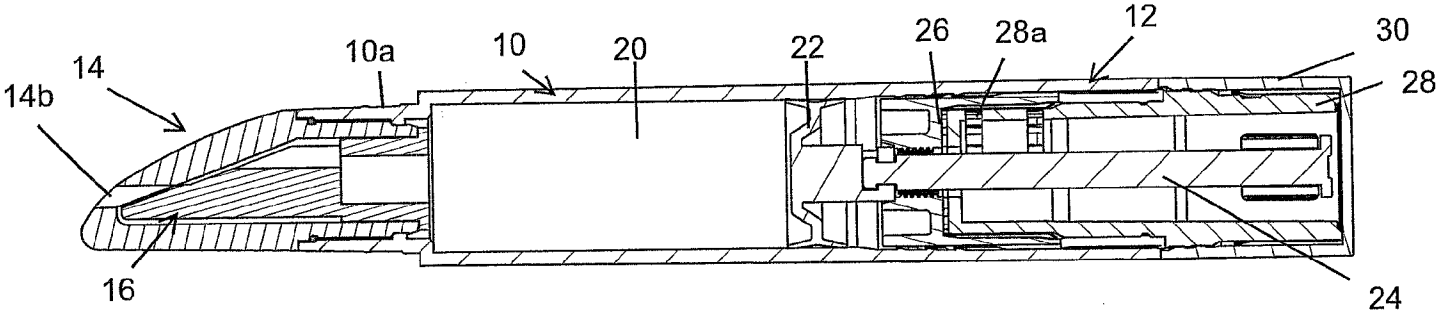
FIG. 1*d* is a sectional view, cut along a line I-II in FIG. 1*b;*
Figure 1E:
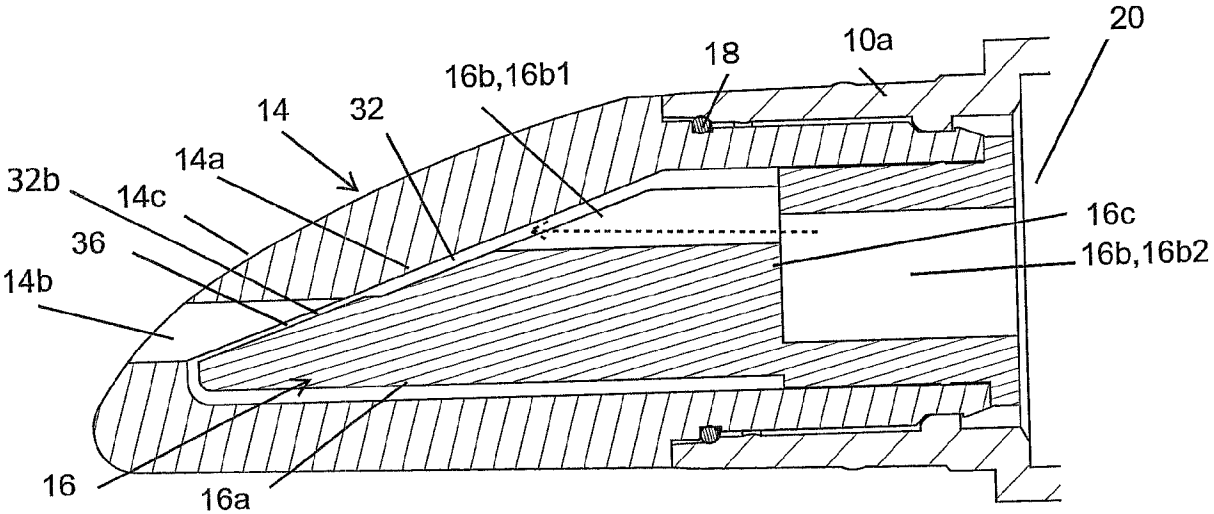
FIG. 1*e* is an enlarged view around the application body in FIG. 1*d;*
Figure 2B:
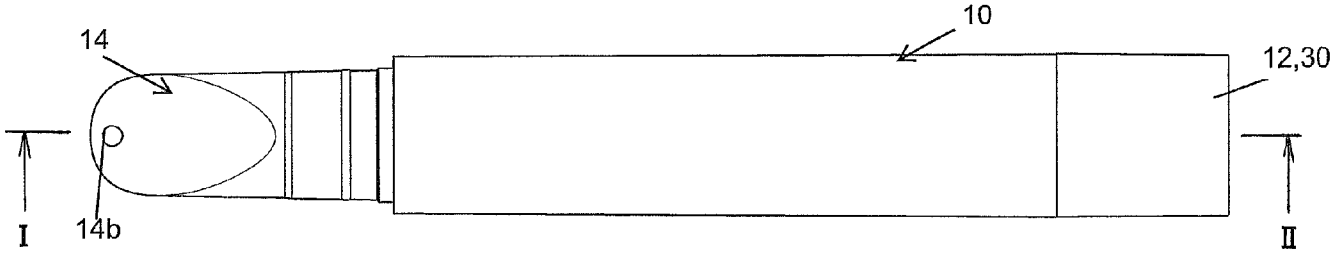
FIG. 2*b* is a plan view of the applicator according to the embodiment 2 of the present invention, viewed from the application body's slope side.
Figure 2C:
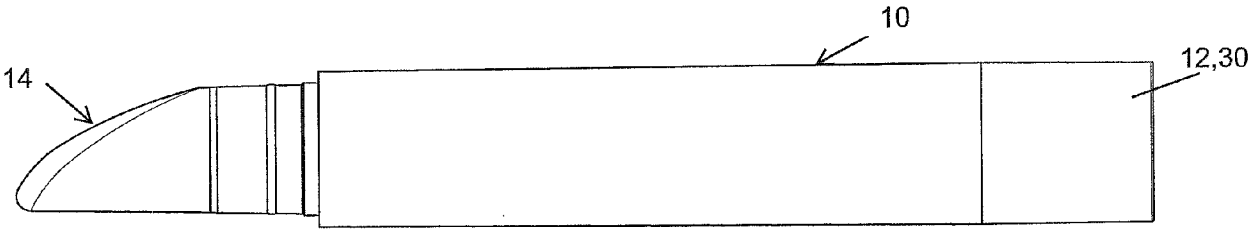
FIG. 2*c* is a side view of the applicator according to the embodiment 2 of the present invention.
Figure 2A:
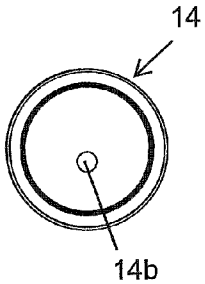
FIG. 2*a* is a view of an applicator according to the embodiment 2 of the present invention, viewed from the front of the applicator.
Figure 2D:
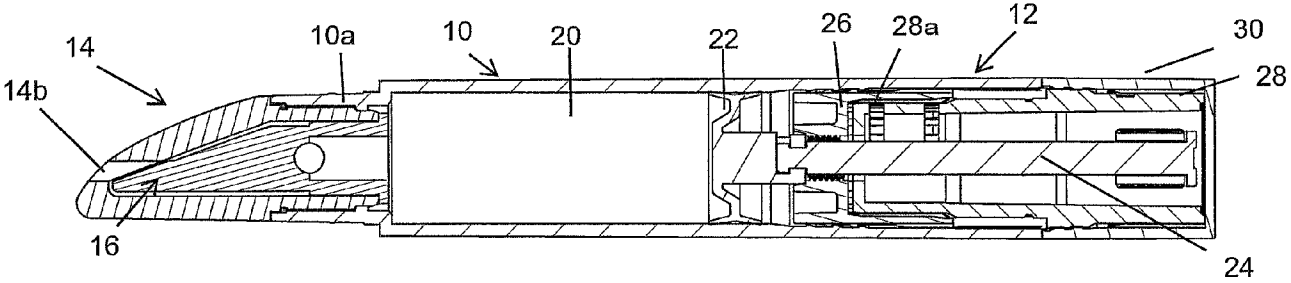
FIG. 2*d* is a sectional view, cut along a line I-II in FIG. 2*b;*
Figure 2E:
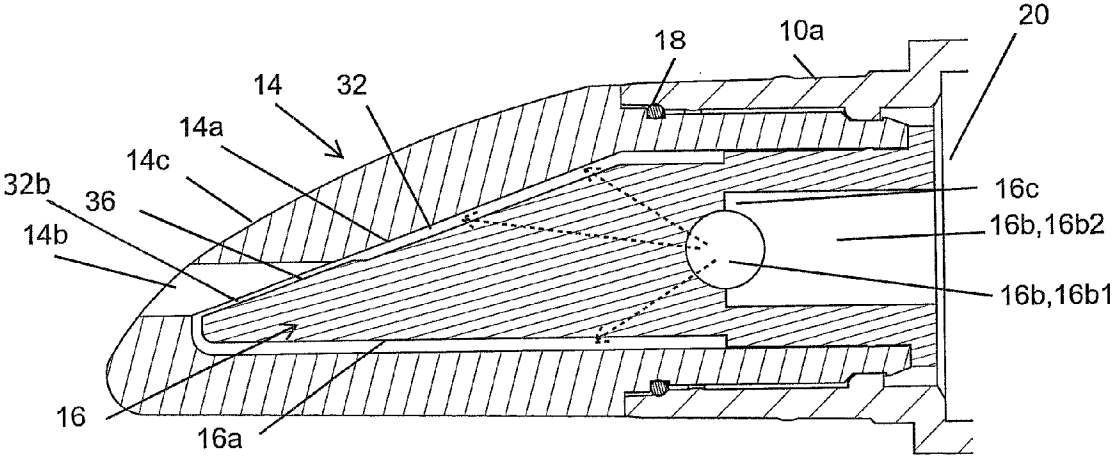
FIG. 2*e* is an enlarged view around the application body in FIG. 2*d;*
Figure 3B:
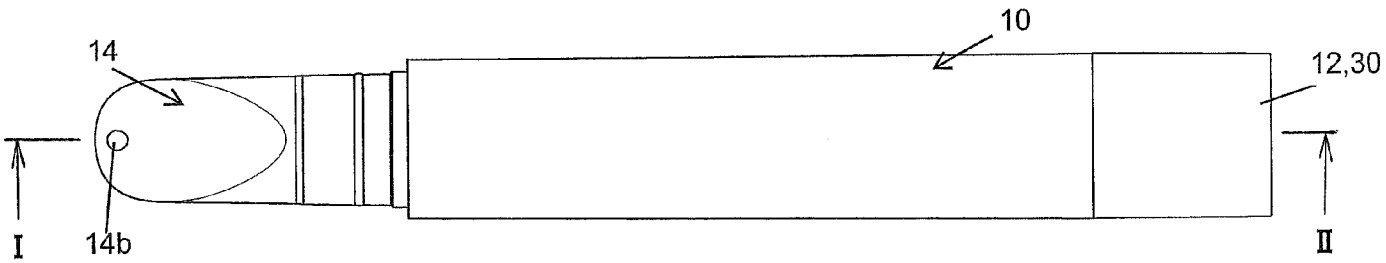
FIG. 3*b* is a plan view of the applicator according to the embodiment 3 of the present invention, viewed from the application body's slope side.
Figure 3C:
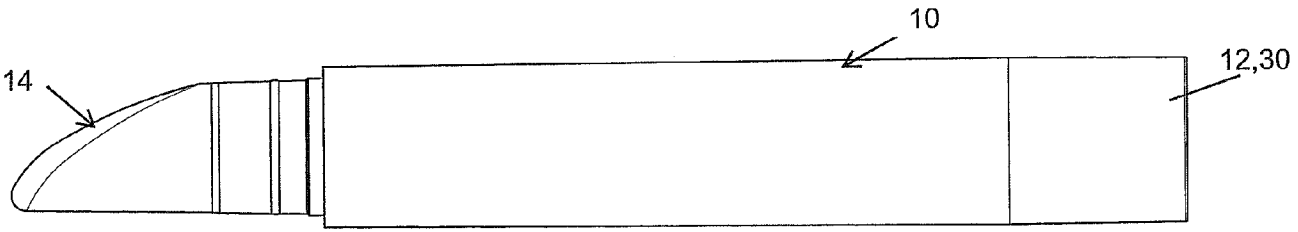
FIG. 3*c* is a side view of the applicator according to the embodiment 3 of the present invention.
Figure 3A:
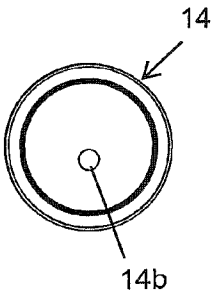
FIG. 3*a* is a view of an applicator according to the embodiment 3 of the present invention, viewed from the front of the applicator.
Figure 3D:
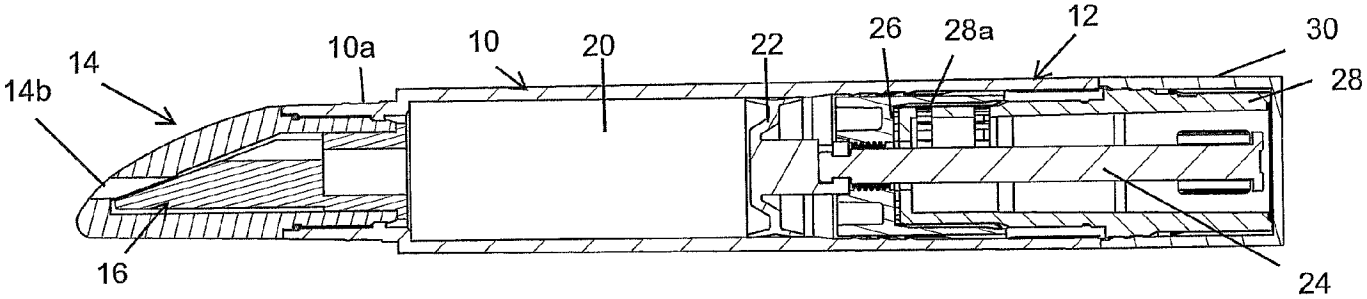
FIG. 3*d* is a sectional view, cut along a line I-II in FIG. 3*b;*
Figure 3E:
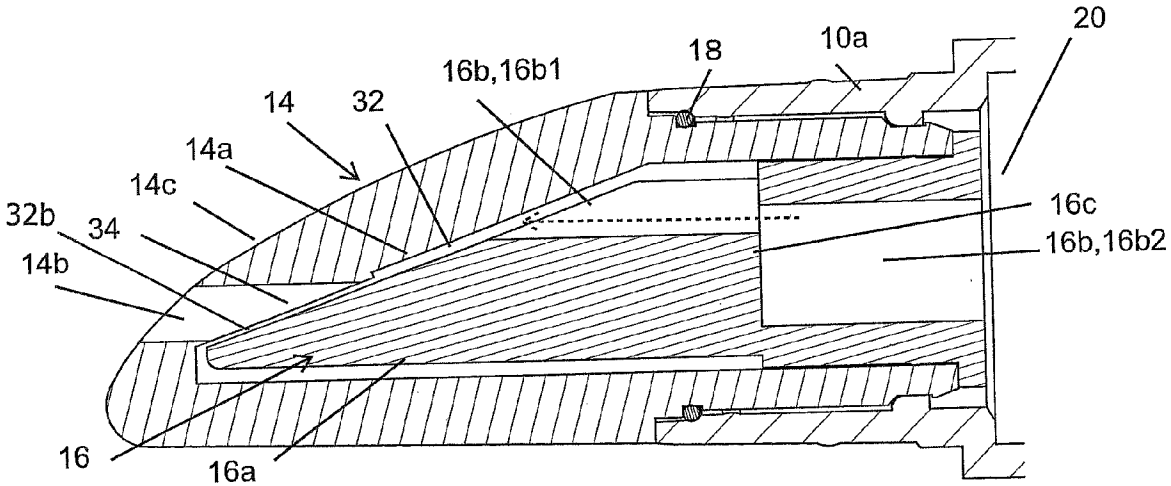
FIG. 3*e* is an enlarged view around the application body in FIG. 3*d;*
Figure 4B:
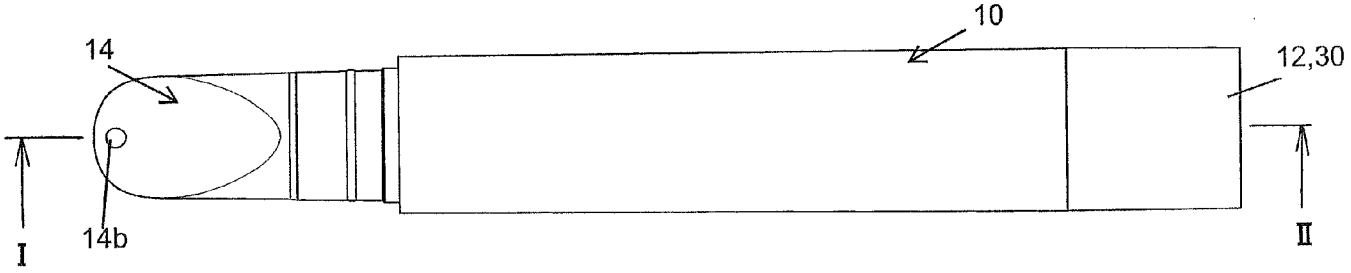
FIG. 4*b* is a plan view of the applicator according to the embodiment 4 of the present invention, viewed from the application body's slope side.
Figure 4C:
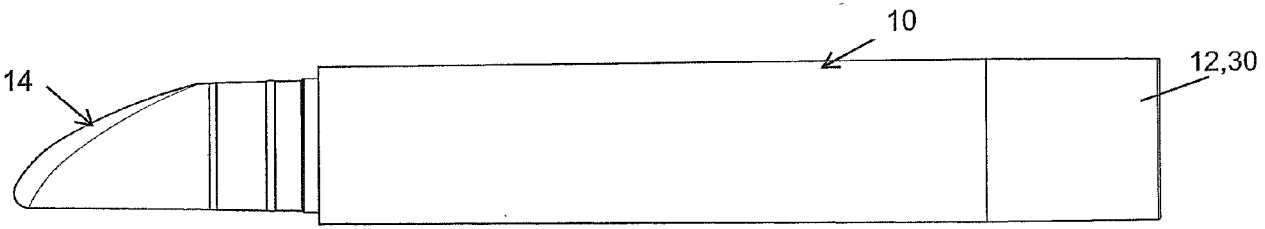
FIG. 4*c* is a side view of the applicator according to the embodiment 4 of the present invention.
Figure 4A:
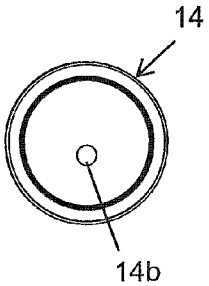
FIG. 4*a* is a view of an applicator according to the embodiment 4 of the present invention, viewed from the front of the applicator.
Figure 4D:
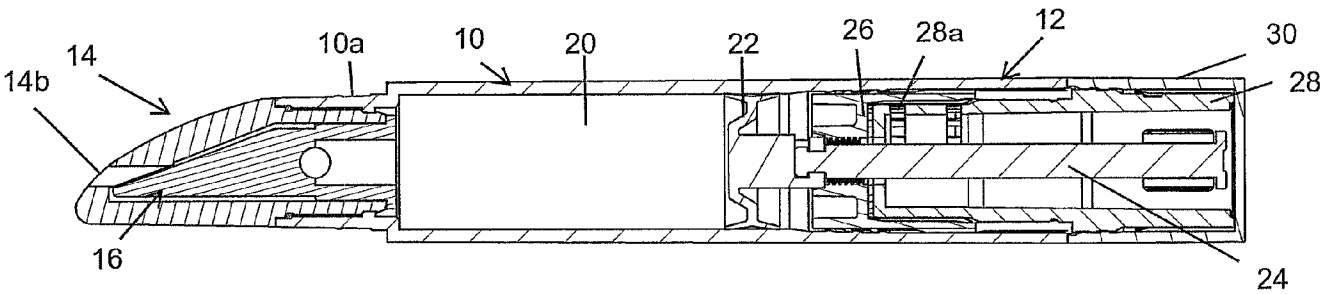
FIG. 4*d* is a sectional view, cut along a line I-II in FIG. 4*b;*
Figure 4E:
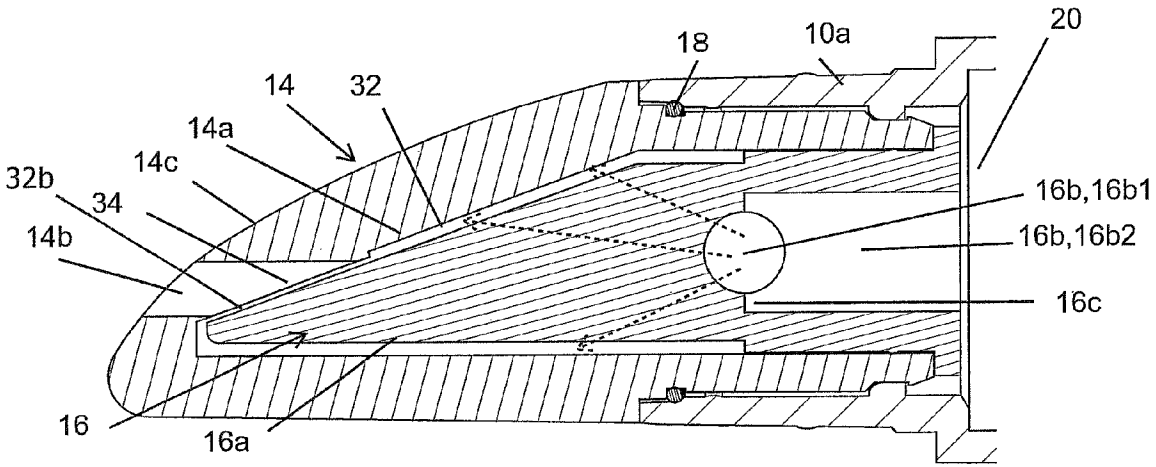
FIG. 4*e* is an enlarged view around the application body in FIG. 4*d;*
Figure 5B:
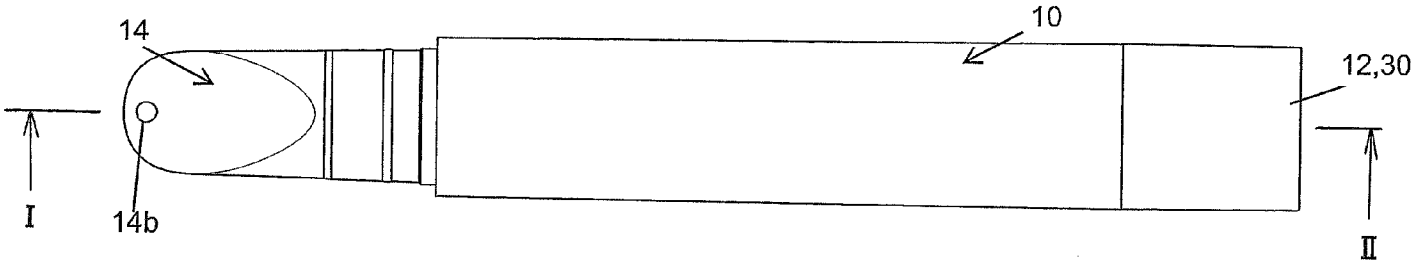
FIG. 5*b* is a plan view of the applicator according to the embodiment 5 of the present invention, viewed from the application body's slope side.
Figure 5C:
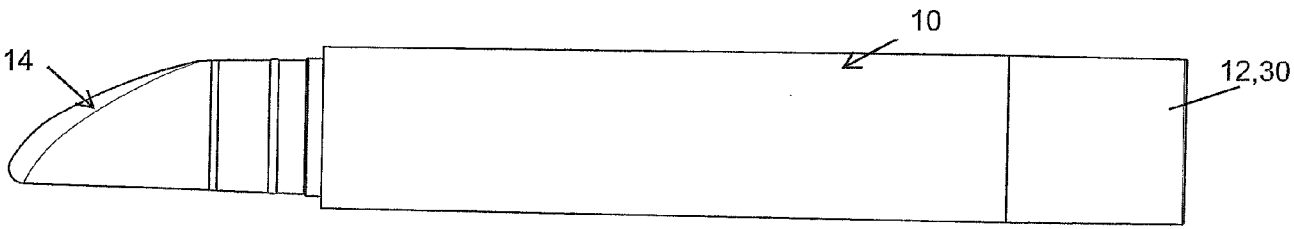
FIG. 5*c* is a side view of the applicator according to the embodiment 5 of the present invention.
Figure 5A:
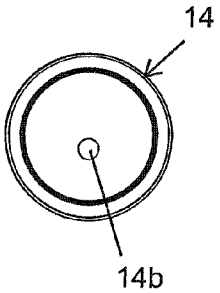
FIG. 5*a* is a view of an applicator according to the embodiment 5 of the present invention, viewed from the front of the applicator.
Figure 5D:
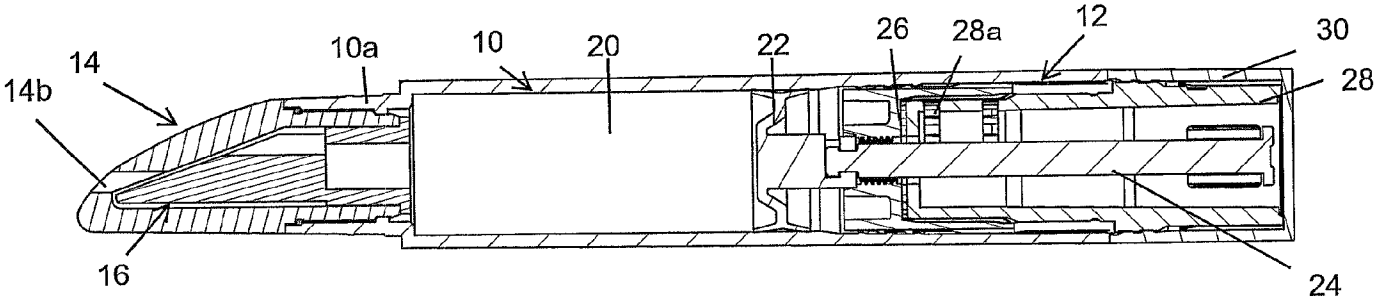
FIG. 5*d* is a sectional view, cut along a line I-II in FIG. 5*b;*
Figure 5E:
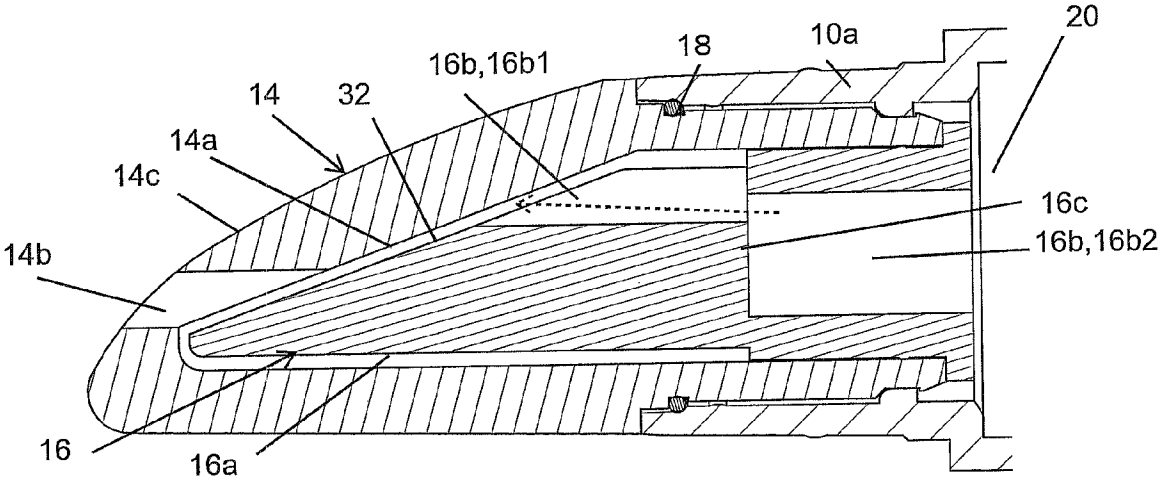
FIG. 5*e* is an enlarged view around the application body in FIG. 5*d;*
Figure 6B:
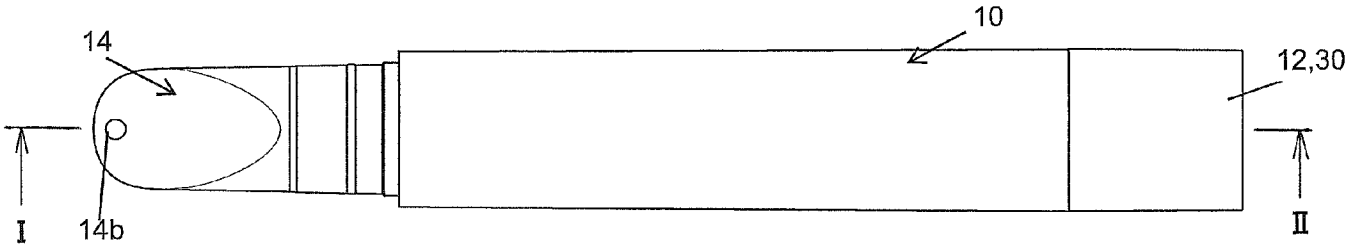
FIG. 6*b* is a plan view of the applicator according to the embodiment 6 of the present invention, viewed from the application body's slope side.
Figure 6C:
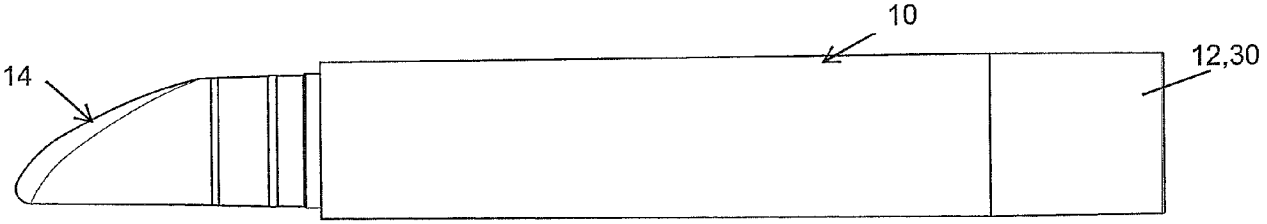
FIG. 6*c* is a side view of the applicator according to the embodiment 6 of the present invention.
Figure 6A:
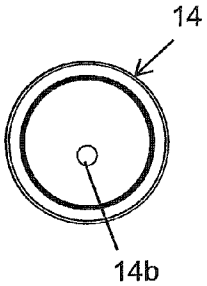
FIG. 6*a* is a view of an applicator according to the embodiment 6 of the present invention, viewed from the front of the applicator.
Figure 6D:
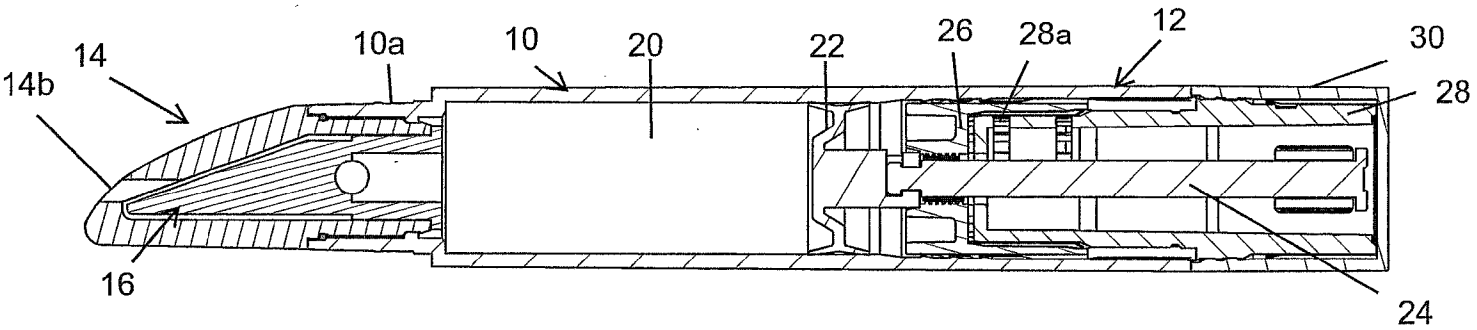
FIG. 6*d* is a sectional view, cut along a line I-II in FIG. 6*b;*
Figure 6E:
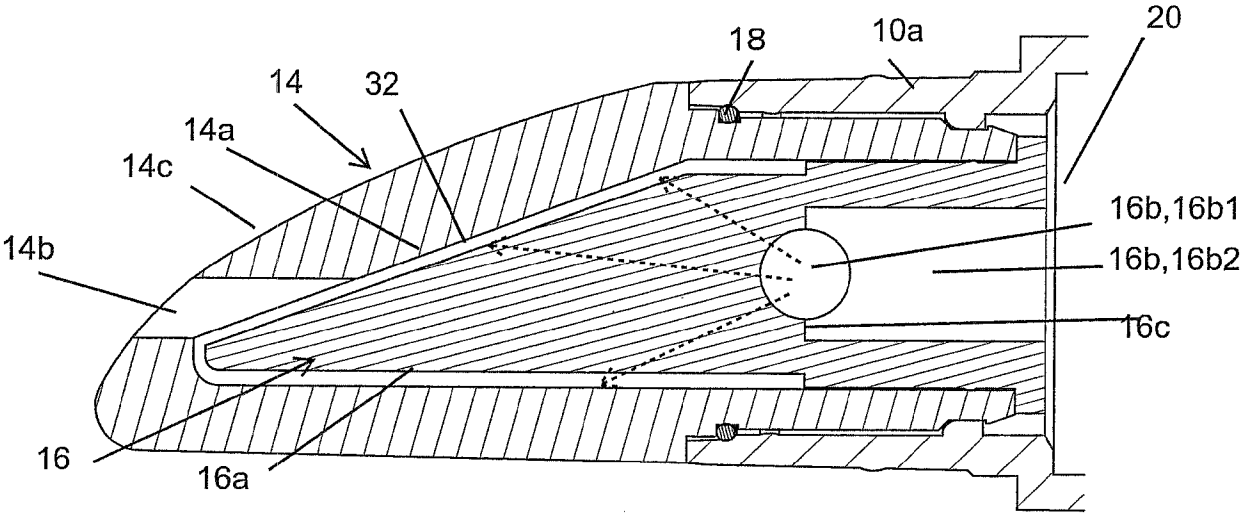
FIG. 6*e* is an enlarged view around the application body in FIG. 6*d;*
Figure 7B:
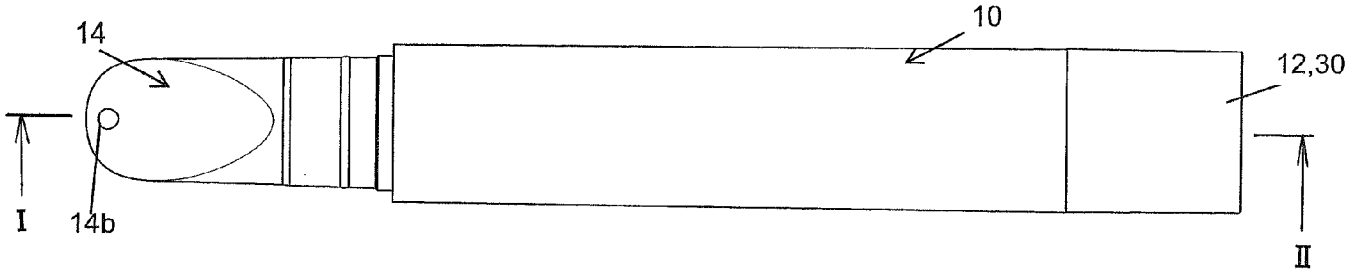
FIG. 7*b* is a plan view of the applicator according to the embodiment 7 of the present invention, viewed from the application body's slope side.
Figure 7C:
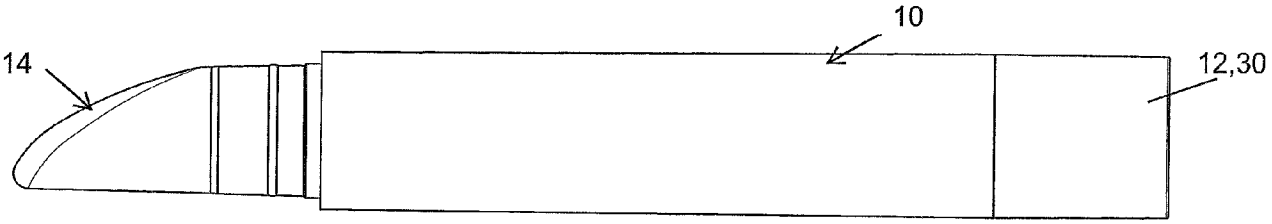
FIG. 7*c* is a side view of the applicator according to the embodiment 7 of the present invention.
Figure 7A:
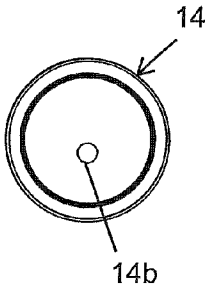
FIG. 7*a* is a view of an applicator according to the embodiment 7 of the present invention, viewed from the front of the applicator.
Figure 7D:
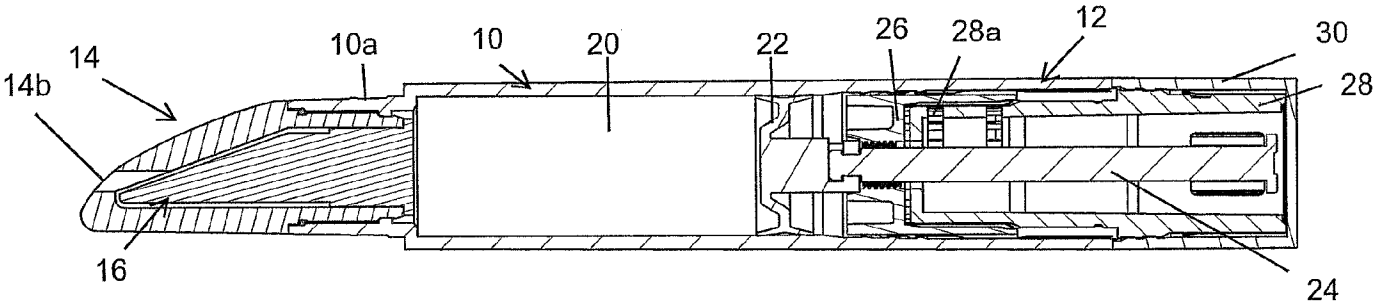
FIG. 7*d* is a sectional view, cut along a line I-II in FIG. 7*b;*
Figure 7E:
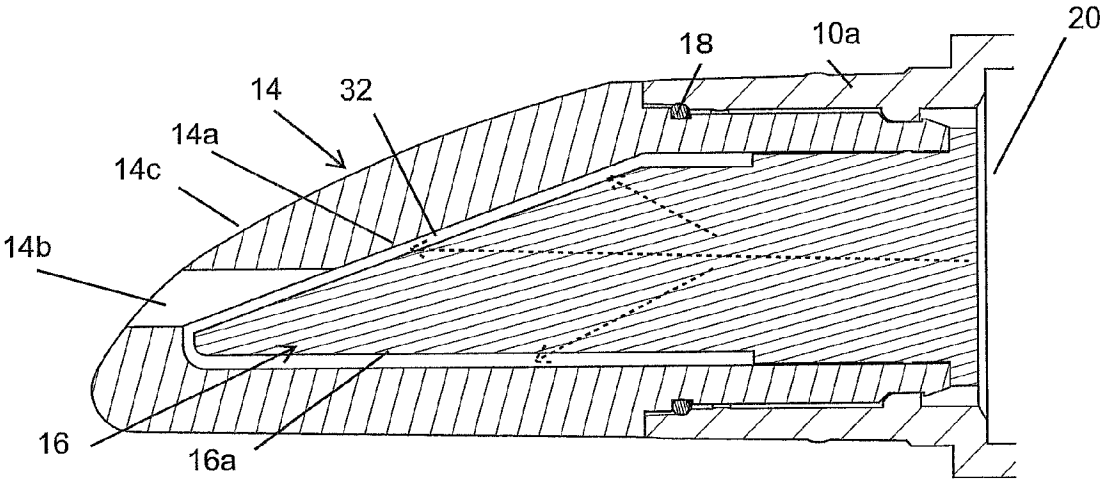
FIG. 7*e* is an enlarged view around the application body in FIG. 7*d;*
Figure 8B:
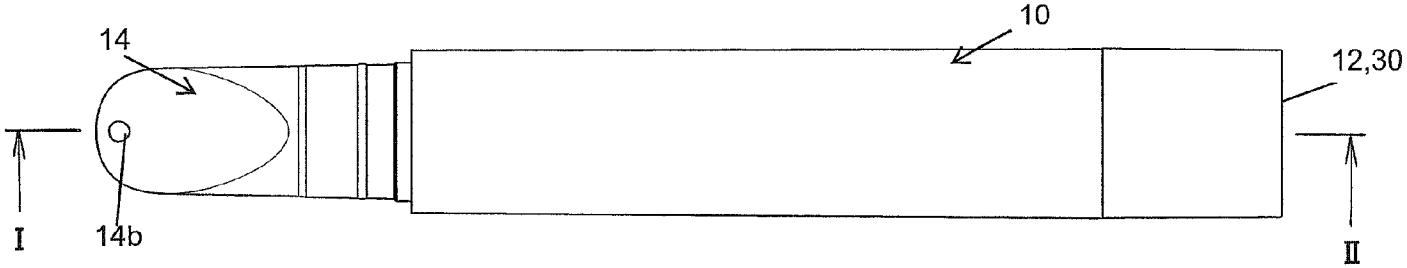
FIG. 8*b* is a plan view of the applicator according to the embodiment 8 of the present invention, viewed from the application body's slope side.
Figure 8C:
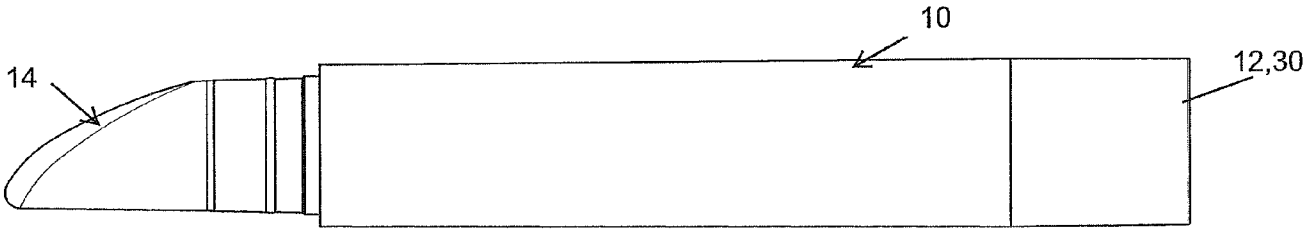
FIG. 8*c* is a side view of the applicator according to the embodiment 8 of the present invention.
Figure 8A:
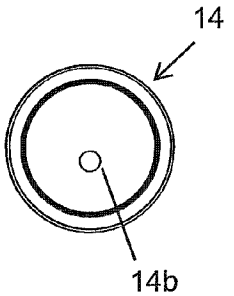
FIG. 8*a* is a view of an applicator according to the embodiment 8 of the present invention, viewed from the front of the applicator.
Figure 8D:
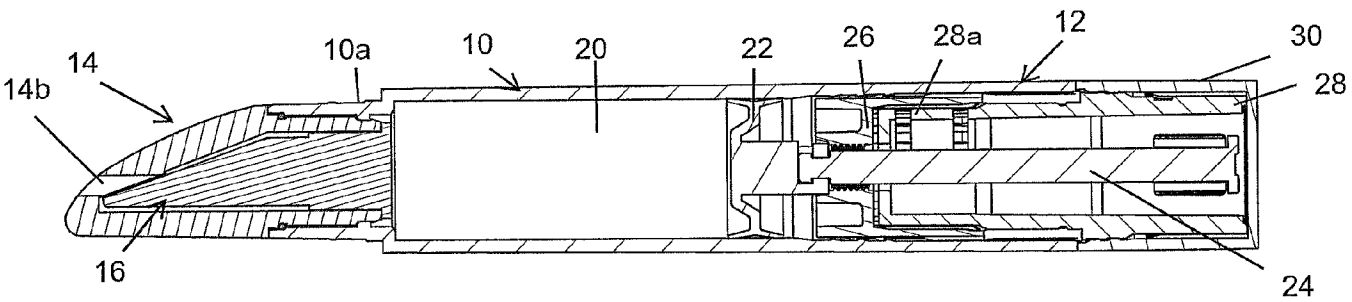
FIG. 8*d* is a sectional view, cut along a line I-II in FIG. 8*b;*
Figure 8E:
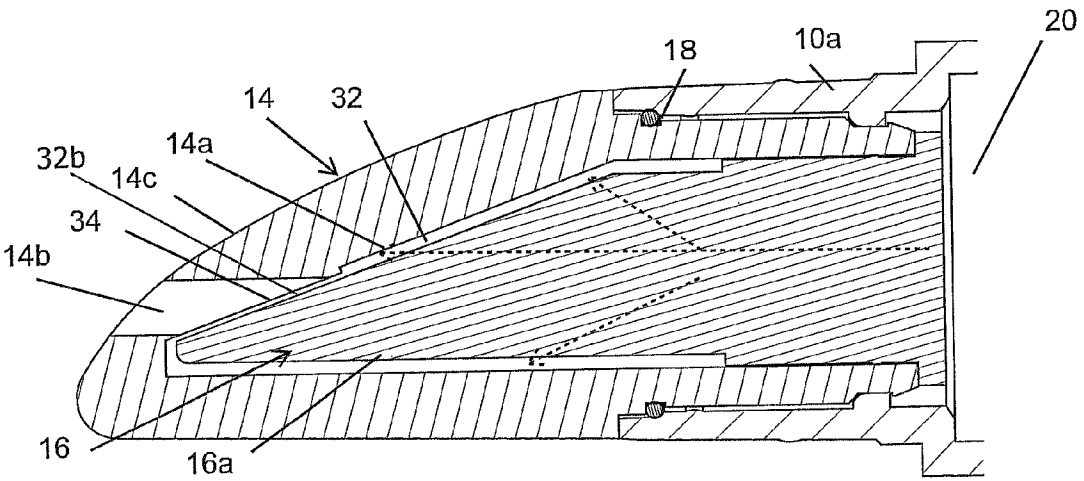
FIG. 8*e* is an enlarged view around the application body in FIG. 8*d;*
Figure 9B:
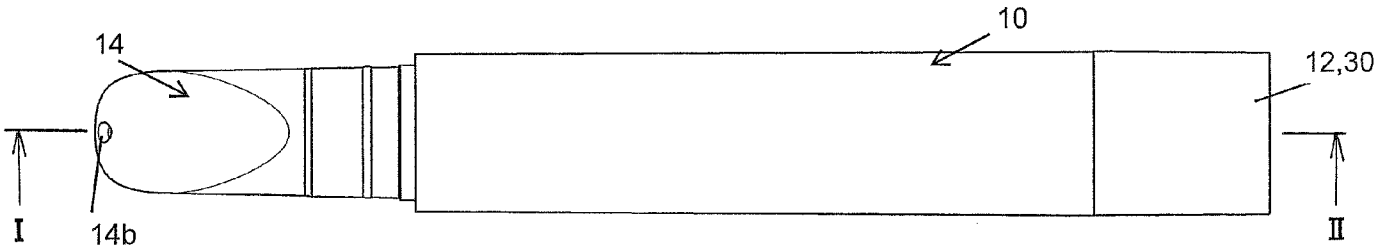
FIG. 9*b* is a plan view of the applicator according to the embodiment 9 of the present invention, viewed from the application body's slope side.
Figure 9C:
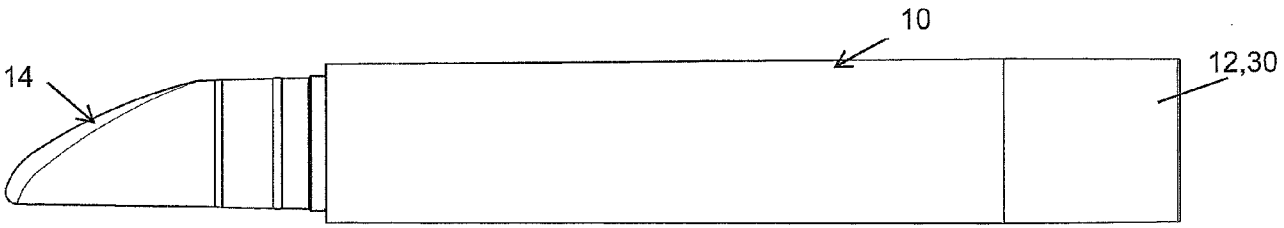
FIG. 9*c* is a side view of the applicator according to the embodiment 9 of the present invention.
Figure 9A:
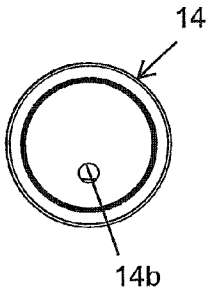
FIG. 9*a* is a view of an applicator according to the embodiment 9 of the present invention, viewed from the front of the applicator.
Figure 9D:
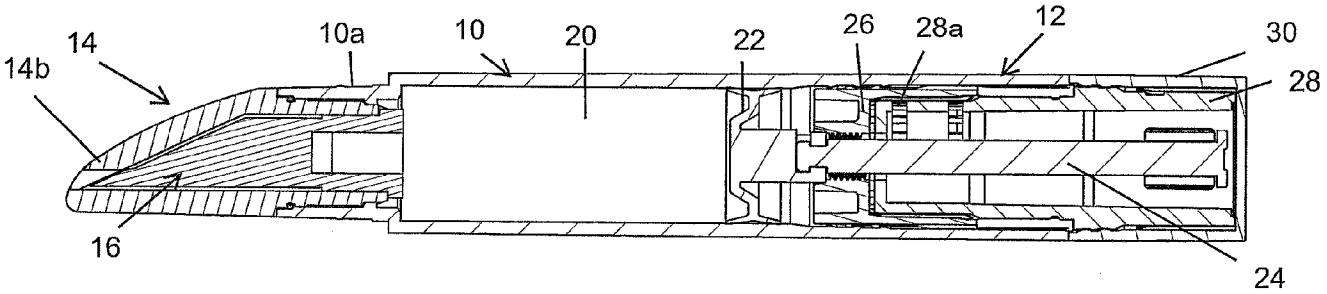
FIG. 9*d* is a sectional view, cut along a line I-II in FIG. 9*b;*
Figure 9E:
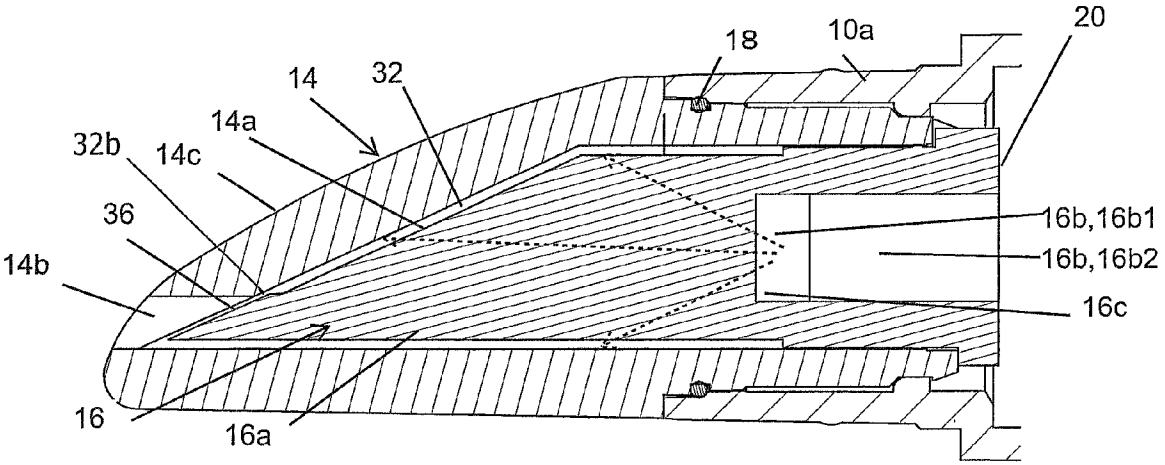
FIG. 9*e* is an enlarged view around the application body in FIG. 9*d;*
Figure 10B:
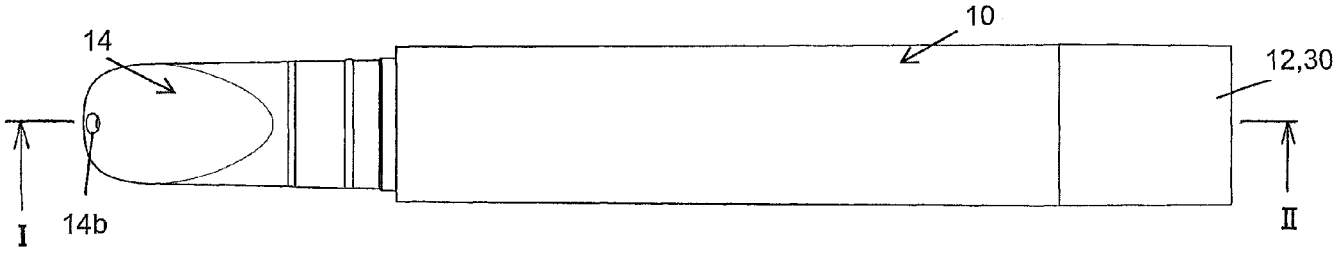
FIG. 10*b* is a plan view of the applicator according to the embodiment 10 of the present invention, viewed from the application body's slope side.
Figure 10C:
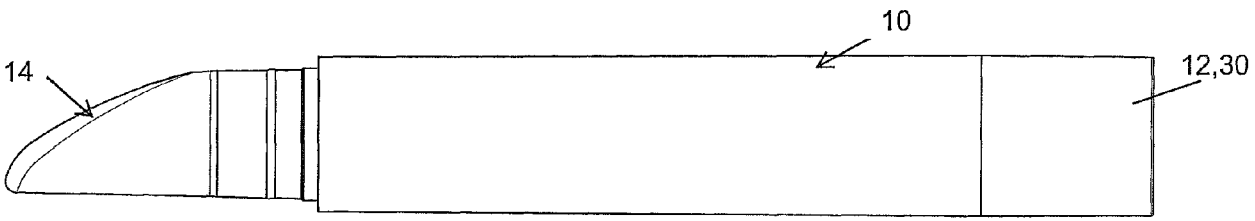
FIG. 10*c* is a side view of the applicator according to the embodiment 10 of the present invention.
Figure 10A:
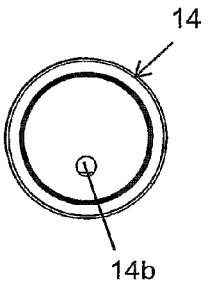
FIG. 10*a* is a view of an applicator according to the embodiment 10 of the present invention, viewed from the front of the applicator.
Figure 10D:
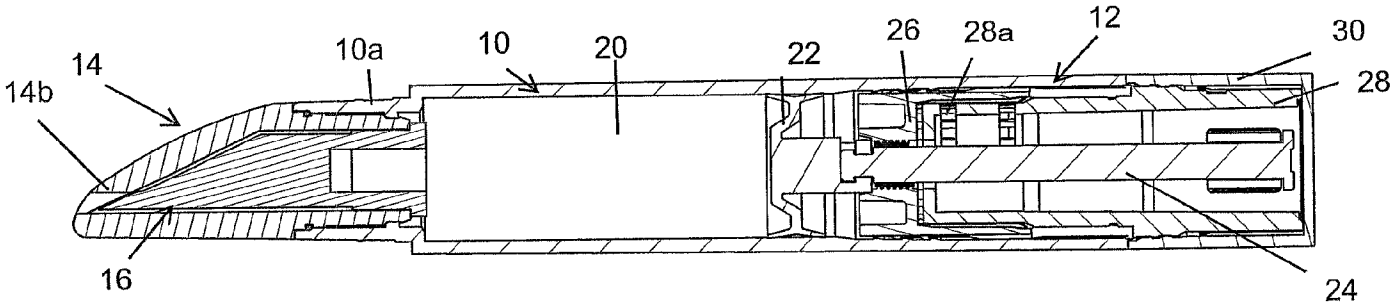
FIG. 10*d* is a sectional view, cut along a line I-II in FIG. 10*b;*
Figure 10E:
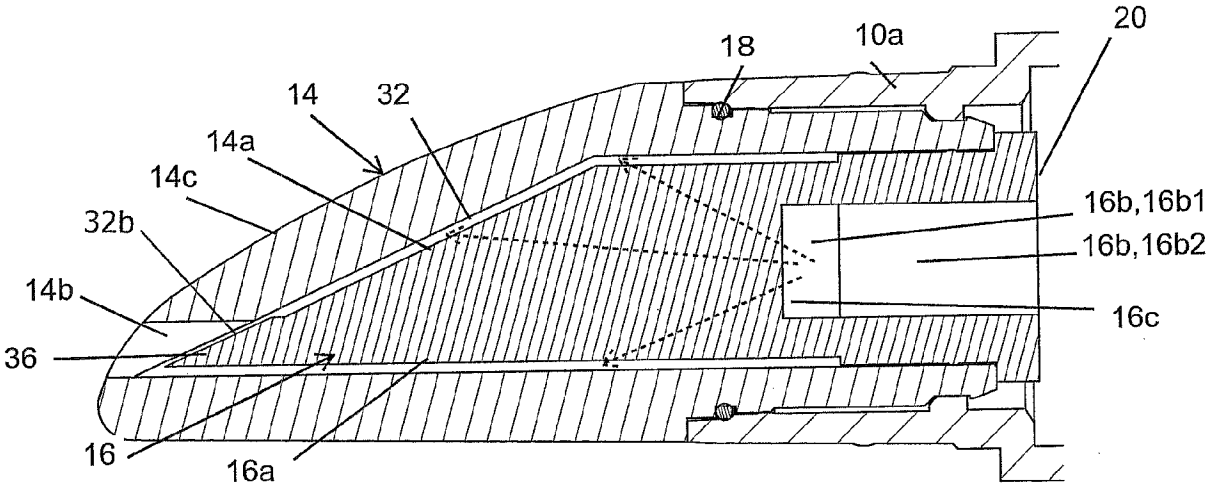
FIG. 10*e* is an enlarged view around the application body in FIG. 10*d;*
Figure 11C:
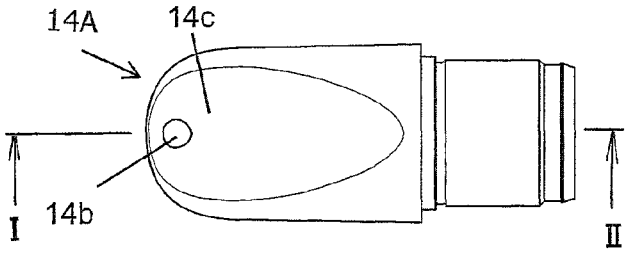
FIG. 11*c* is a plan view of the application body 14A, viewed from the slope side.
Figure 11A:
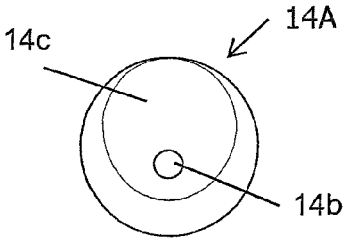
FIG. 11*a* is a view of an application body 14A according to the embodiment of the present invention, viewed from the front.
Figure 11D:
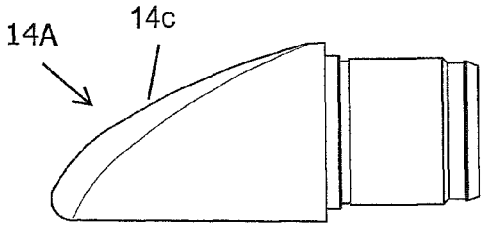
FIG. 11*d* is a side view of the application body 14A.
Figure 11B:
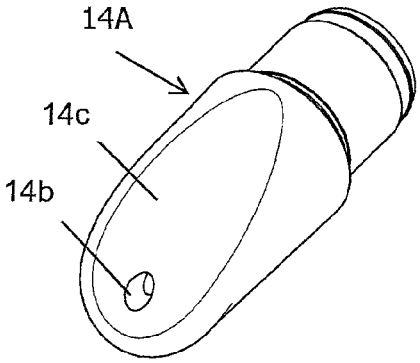
FIG. 11*b* is a perspective view of the application body 14A, viewed from the front.
Figure 11E:
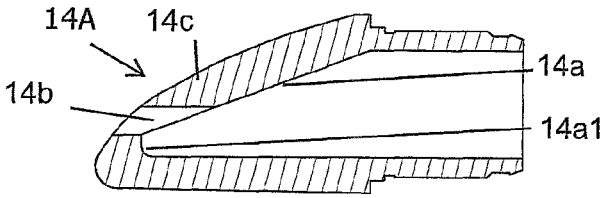
FIG. 11*e* is a sectional view, cut along a line I-II in FIG. 11*c;*
Figure 11F:
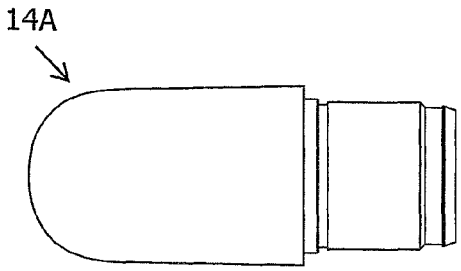
FIG. 11*f* is a backside view of the application body 14A.
Figure 11G:
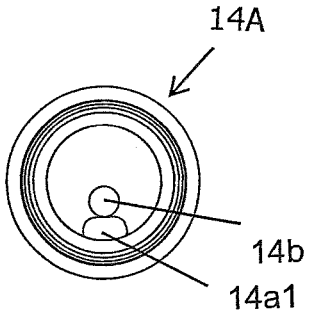
FIG. 11*g* is a view of the application body 14A, viewed from the rear.
Figure 11H:
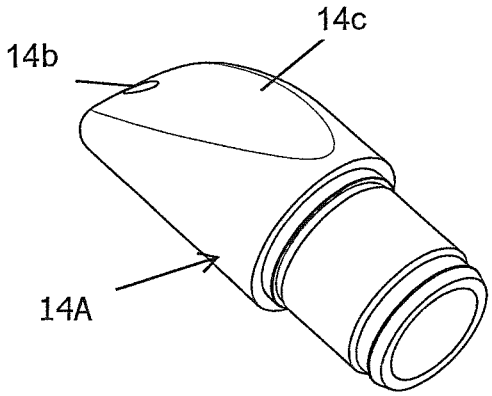
FIG. 11*h* is a perspective view of the application body 14A, viewed from the rear.
Figure 12C:
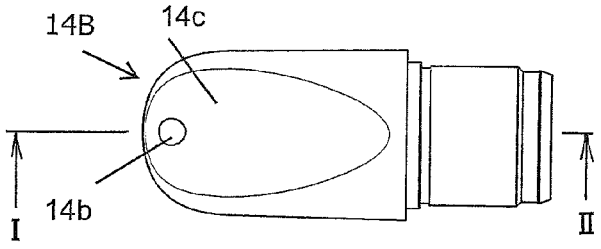
FIG. 12*c* is a plan view of the application body 14B, viewed from the slope side.
Figure 12A:
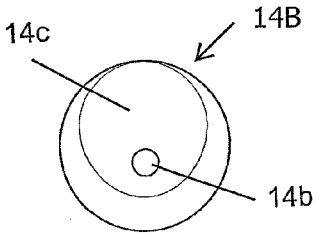
FIG. 12*a* is a view of an application body 14B according to the embodiment of the present invention, viewed from the front.
Figure 12D:
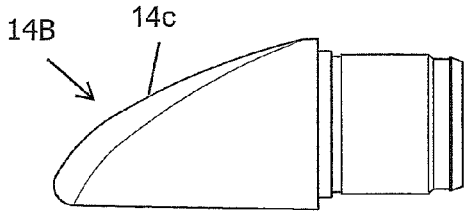
FIG. 12*d* is a side view of the application body 14B.
Figure 12B:
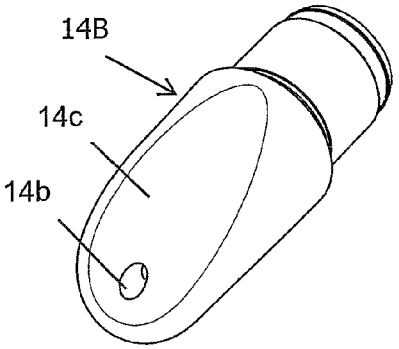
FIG. 12*b* is a perspective view of the application body 14B, viewed from the front.
Figure 12E:
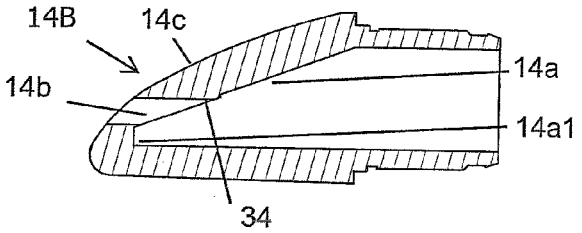
FIG. 12*e* is a sectional view, cut along a line I-II in FIG. 12*c;*
Figure 12F:
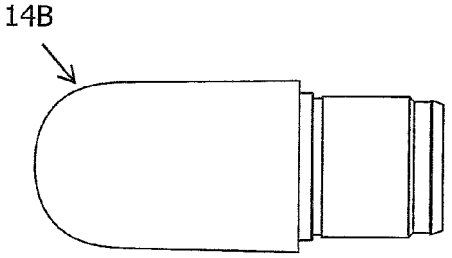
FIG. 12*f* is a backside view of the application body 143.
Figure 12G:
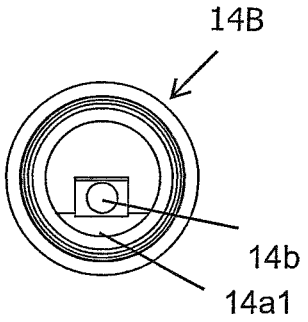
FIG. 12*g* is a view of an application body 14B, viewed from the rear.
Figure 12H:
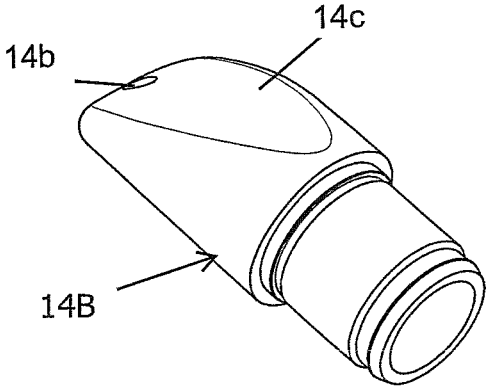
FIG. 12*h* is a perspective view of the application body 14B, viewed from the rear.
Figure 13C:
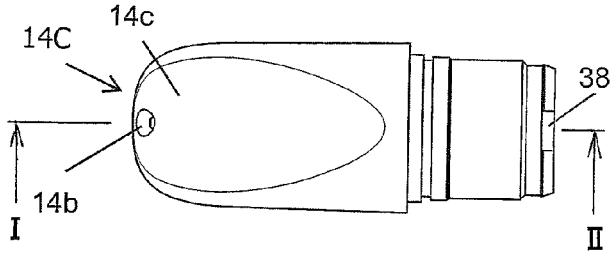
FIG. 13*c* is a plan view of the application body 14C, viewed from the slope side.
Figure 13A:
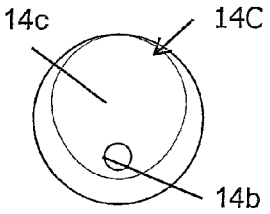
FIG. 13*a* is a view of an application body 14C used for the applicator according to the embodiment of the present invention, viewed from the front.
Figure 13D:
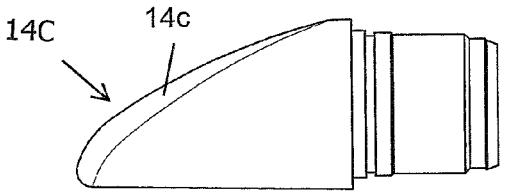
FIG. 13*d* is a side view of the application body 14C.
Figure 13B:
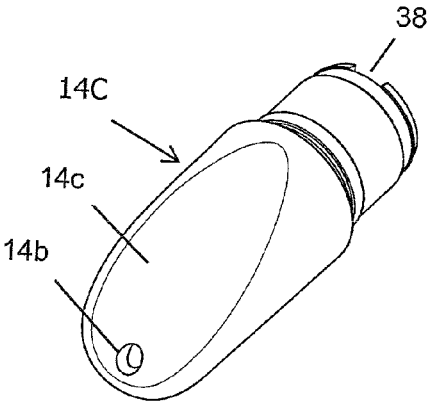
FIG. 13*b* is a perspective view of the application body 14C, viewed from the front.
Figure 13E:
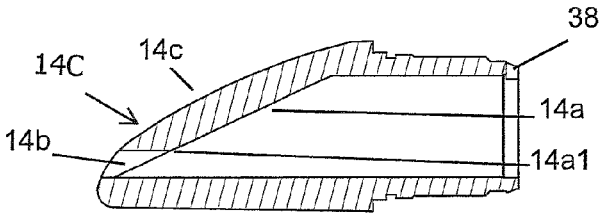
FIG. 13*e* is a sectional view, cut along a line I-II in FIG. 13*c;*
Figure 13F:
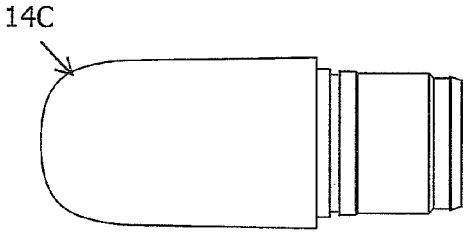
FIG. 13*f* is a backside view of the application body 140.
Figure 13G:
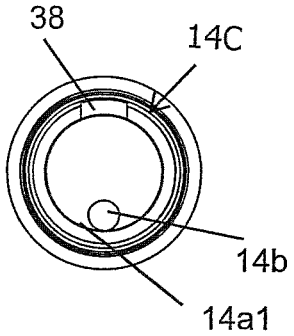
FIG. 13*g* is a view of the application body 14C, viewed from the rear.
Figure 13H:
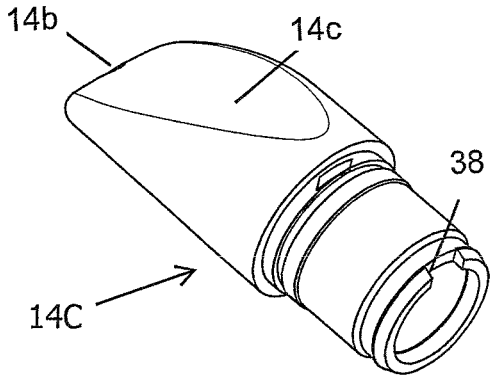
FIG. 13*h* is a perspective view of the application body 14C, viewed from the rear.
Figure 14C:
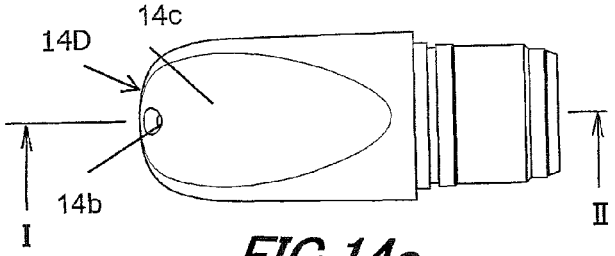
FIG. 14*c* is a plan view of the application body 14D, viewed from the slope side of the application body.
Figure 14A:
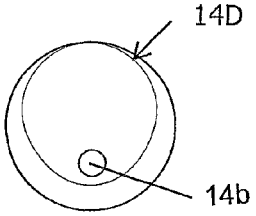
FIG. 14*a* is a view of an application body 14D used for the applicator according to the embodiment of the present invention, viewed from the front.
Figure 14D:
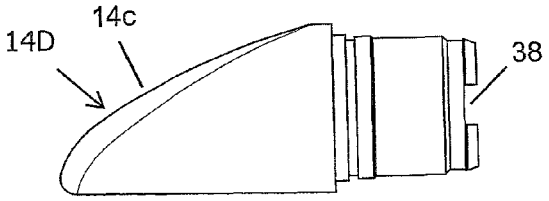
FIG. 14*d* is a side view of the application body 14D.
Figure 14E:
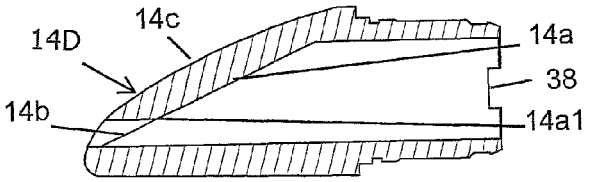
FIG. 14*e* is a sectional view, cut along a line I-II in FIG. 14*c;*
Figure 14B:
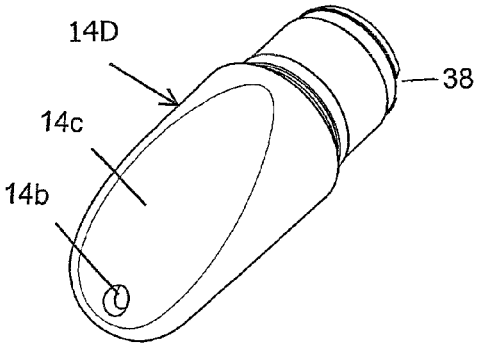
FIG. 14*b* is a perspective view of the application body 14D, viewed from the front.
Figure 14F:
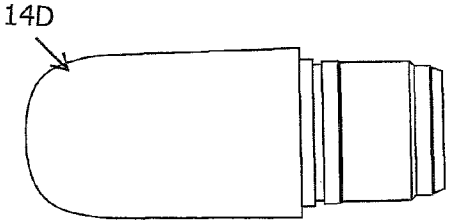
FIG. 14*f* is a backside view of the application body 14D.
Figure 14G:
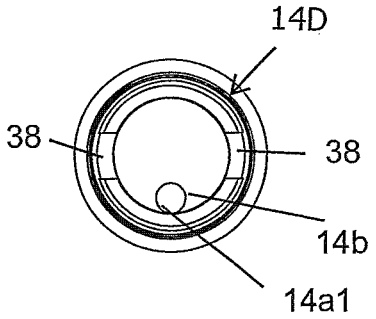
FIG. 14*g* is a view of the application body 14D, viewed from the rear.
Figure 14H:
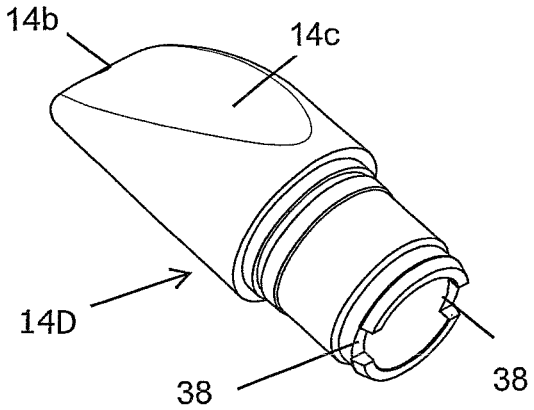
FIG. 14*h* is a perspective view of the application body 14D, viewed from the rear.

Of the inner surface of application body 14B or the application body interior face 14*a* (FIG. 12*e*), the interior side of the applying face 14*c* (FIG. 12*e*) is formed so that the peripheral area of the delivery port 14*b* is stepped and made thicker, forming an application body-side projected area (FIG. 12*e*).

Further, in the interior side of the applying face 14*c* (FIG. 12*e*), the interior front end face, designated at 14*a*1 (FIGS. 12*e* and 12*g*) under the delivery port 14*b* (located on the front side of the delivery port 14*b* in the application body 14B), is formed with a corner of an angle. The other configurations are the same as those of the application body 14A, so the same components are allotted with the same reference numerals.

In the application body 14C, as shown in FIG. 13, an applying face 14*c* is roughly a slope inclined to the axis and formed to have a slightly arced swelling surface. A delivery port 14*b* is perforated at the front end of the applying face 14*c*.

Of the inner surface of the application body 14C or the application body interior face 14*a* (FIG. 13*e*), the interior side of the applying face 14*c* is formed flat.

The interior face 14*a* has an inner front end face 14*a*1 (FIG. 13*e*) formed around the delivery port 14*b* in an acute angle in the vertical section, and part of the inner face of the delivery port 14*b* is linearly extended rearward contiguously to the interior face 14*a*.

Further, an indentation 38 for preventing rotation when the spacer 16 (spacer 16F in FIGS. 20*a* to 20*h*) is attached (and engaged with projection 42) is formed at a place on the slope side at the rear end of the rear cylindrical part of the application body 14C. The other configurations are the same as those of the application body 14B, so the same components are allotted with the same reference numerals.

In the application body 14D, as shown in FIG. 14, an interior face 14*a*, applying face 14*c*, delivery port 14*b* and others are formed in the same manner as in the application body 14C. The rear end of the rear cylindrical part of the application body 14D is formed on both sides thereof with two indentations 38 for preventing rotation when the spacer 16 (projections 42 of the spacer 16G in FIG. 21) is attached (and engaged with projections 42). The other configurations are the same as those of the application body 14C, so the same components are allotted with the same reference numerals.

Next, examples of spacer 16, spacers 16A to 16G will be described.

Spacers 16A to 16G each have a configuration as in Table 3 below.

TABLE 3

| Spacer Configuration | | | |
|---|---|---|---|
| | Step | Communication Hole | Anti-rotation |
| Spacer 16A | Formed | 1 round hole | None |
| Spacer 16B | Formed | 2 round holes | None |
| Spacer 16C | None | 1 round hole | None |
| Spacer 16D | None | 2 round holes | None |
| Spacer 16E | None | None | None |
| Spacer 16F | Formed | 2 rect. holes | 1 place |
| Spacer 16G | Formed | 2 rect. holes | 2 places |

As shown in FIG. 15, the spacer 16A has a slope on the front end side of the exterior face 16*a*, part of the slope being projected one step higher forming the spacer-side projected area 36. A communication hole 16*b*1 is formed from the rear part of the slope (on the side of the slope opposite from the spacer-side projected area 36) to form an opening.

The spacer 16A has the communication hole 16*b*1 and a communication hole 16*b*2.

The communication hole 16*b*1 has a U-shaped cross-section, and is linearly extended in the axial direction from the slope of exterior face 16*a* of the spacer 16A along the external surface of the spacer 16A. The front end of the communication hole 16*b*1 is open obliquely along the slope.

Figure 15C:
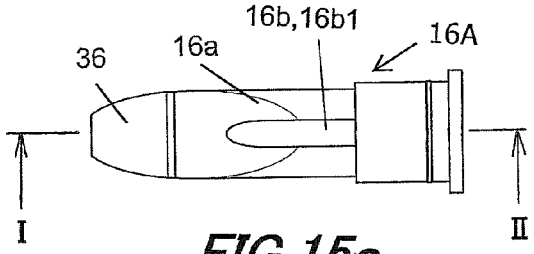
FIG. 15*c* is a plan view of the spacer 16A, viewed from the slope side.
Figure 15A:
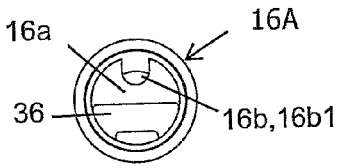
FIG. 15*a* is a view of a spacer 16A used for the applicator according to the embodiment of the present invention, viewed from the front.
Figure 15D:
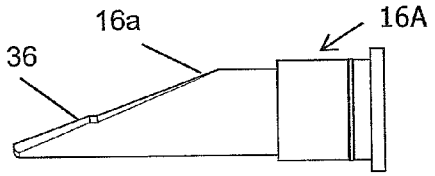
FIG. 15*d* is a side view of the spacer 16A.
Figure 15E:
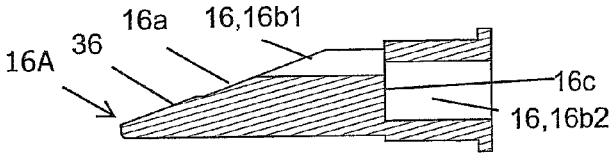
FIG. 15*e* is a sectional view, cut along a line I-II in FIG. 15*c;*
Figure 15B:
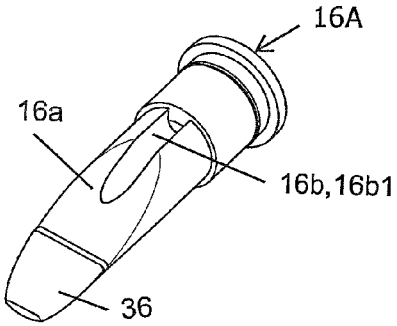
FIG. 15*b* is a perspective view of the spacer 16A, viewed from the front.
Figure 15F:
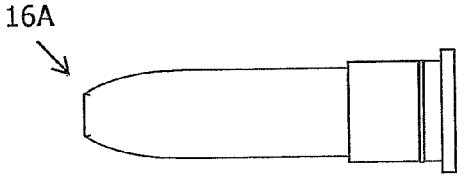
FIG. 15*f* is a backside view of the spacer 16A.
Figure 15G:
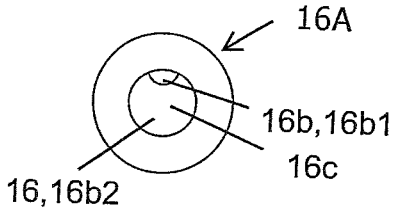
FIG. 15*g* is a view of the spacer 16A, viewed from the rear.
Figure 15H:
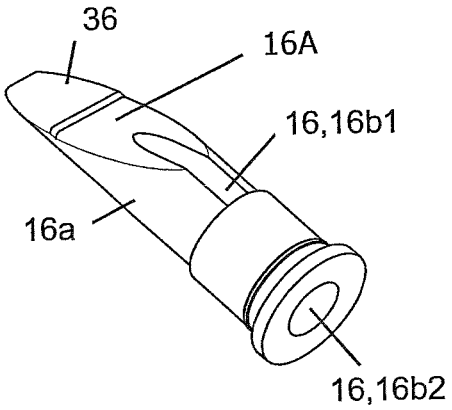
FIG. 15*h* is a perspective view of the spacer 16A, viewed from the rear.
Figure 16C:
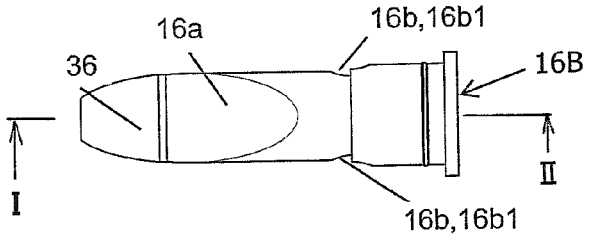
FIG. 16*c* is a plan view of the spacer 16B, viewed from the slope side.
Figure 16A:
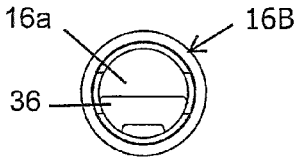
FIG. 16*a* is a view of a spacer 16B used for the applicator according to the embodiment of the present invention, viewed from the front.
Figure 16D:
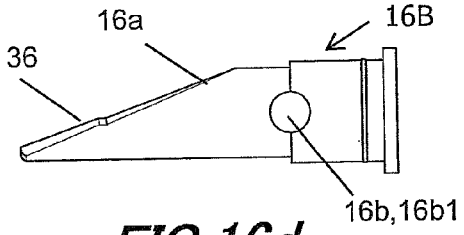
FIG. 16*d* is a side view of the spacer 16B.
Figure 16E:
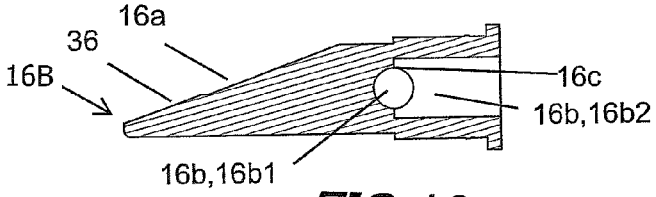
FIG. 16*e* is a sectional view, cut along a line I-II in FIG. 16*c;*
Figure 16B:
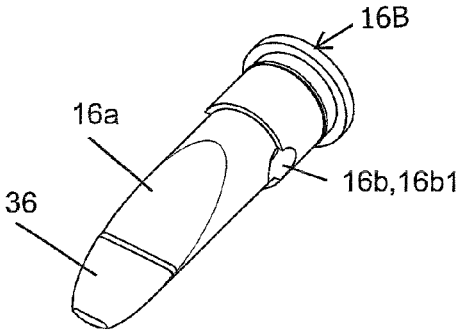
FIG. 16*b* is a perspective view of the spacer 16B, viewed from the front.
Figure 16F:
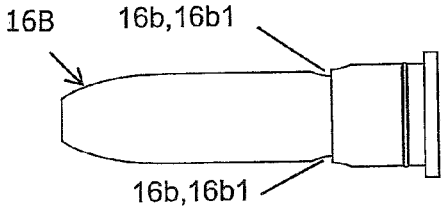
FIG. 16*f* is a backside view of the spacer 16B.
Figure 16G:
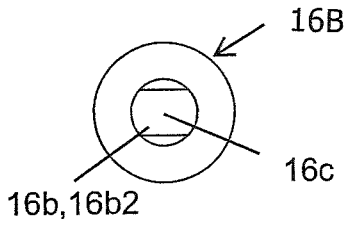
FIG. 16*g* is a view of the spacer 16B, viewed from the rear.
Figure 16H:
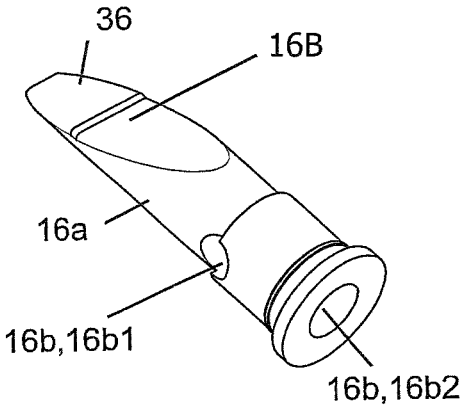
FIG. 16*h* is a perspective view of the spacer 16B, viewed from the rear.

The communication hole 16*b*2 is arranged in the rear cylindrical part of the spacer 16A (on the application liquid reservoir space 20 side), being formed in the axial center of the spacer 16A with a greater diameter than the communication hole 16*b*1 (see FIG. 15*e*). That is, the communication hole 16*b*2 is formed wider than the communication hole 16*b*1.

The communication hole 16*b*2 is connected via a stepped wall 16*c* at its front end with the communication hole 16*b*1 while the rear end is connected to the application liquid reservoir space 20.

At the stepped wall 16*c*, part of the opening of the communication hole 16*b*1 communicates with part of the opening of the communication hole 16*b*2 (see FIG. 15*e*).

An annular flange is formed at the rear end of spacer 16A.

Similarly to the spacer 16A, as shown in FIG. 16, a spacer 16B has a slope on the front end side of an exterior face 16*a*, part of the slope being projected one step higher forming the spacer-side projected area 36.

Differing from the spacer 16A, openings of communication holes 16*b*1 are formed on both sides in the middle part of the spacer, instead of the slope.

In the spacer 16B, a thick communication hole 16*b*2 is formed in the axial center on the rear side while the small-diametric communication holes 16*b*1 are formed radially outward along the stepped wall 16*c* and opened on the outer peripheral of the spacer 16B.

The other configurations are the same as those of the spacer 16A.

Figure 17C:
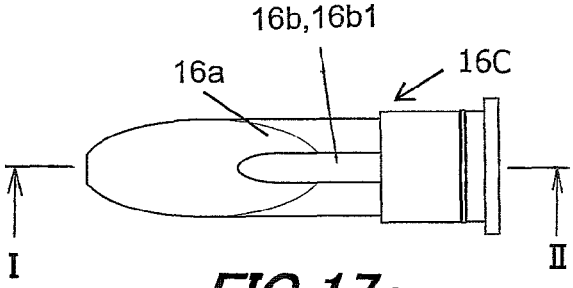
FIG. 17*c* is a plan view of the spacer 16C, viewed from the slope side.
Figure 17A:
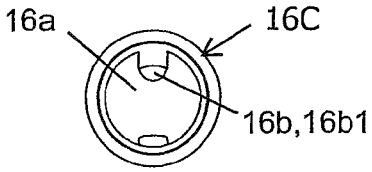
FIG. 17*a* is a view of a spacer 16C used for the applicator according to the embodiment of the present invention, viewed from the front.
Figure 17D:
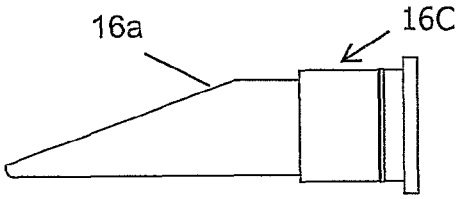
FIG. 17*d* is a side view of the spacer 16C.
Figure 17E:
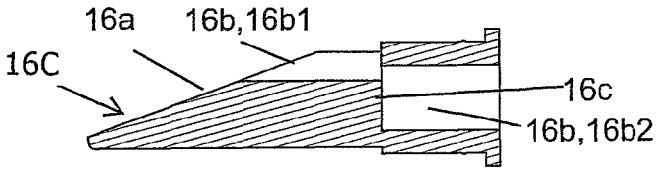
FIG. 17*e* is a sectional view, cut along a line I-II in FIG. 17*c;*
Figure 17B:
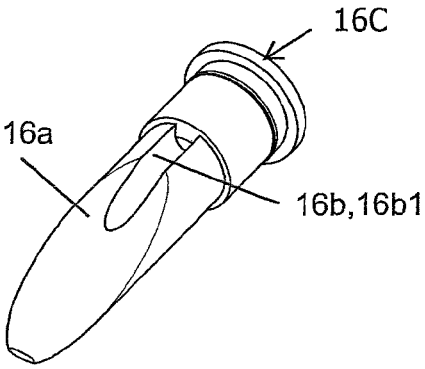
FIG. 17*b* is a perspective view of the spacer 160, viewed from the front.
Figure 17F:
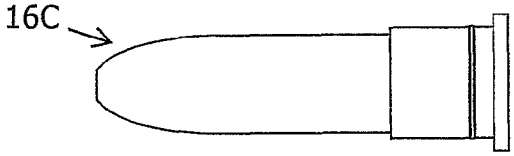
FIG. 17*f* is a backside view of the spacer 16C.
Figure 17G:
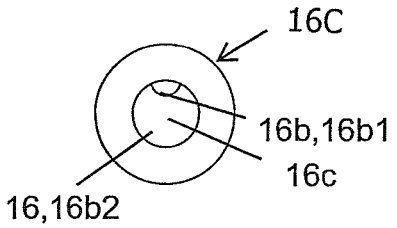
FIG. 17*g* is a view of the spacer 16C, viewed from the rear.
Figure 17H:
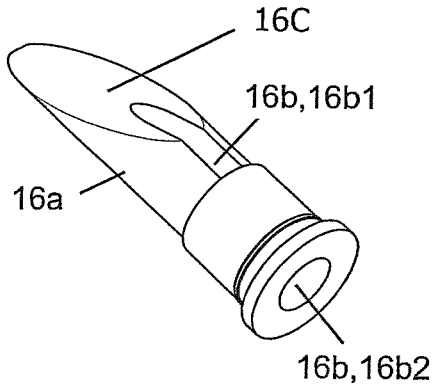
FIG. 17*h* is a perspective view of the spacer 16C, viewed from the rear.
Figure 18C:
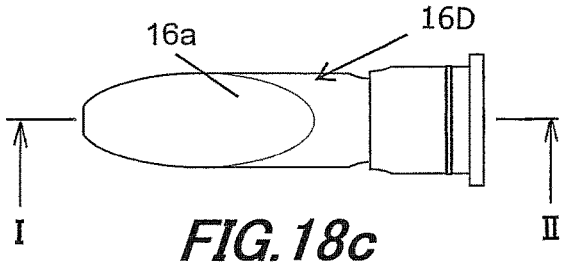
FIG. 18*c* is a plan view of the spacer 16D, viewed from the slope side.
Figure 18A:
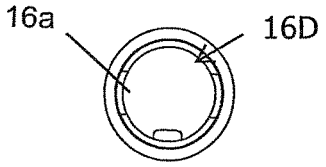
FIG. 18*a* is a view of a spacer 16D used for the applicator according to the embodiment of the present invention, viewed from the front.
Figure 18D:
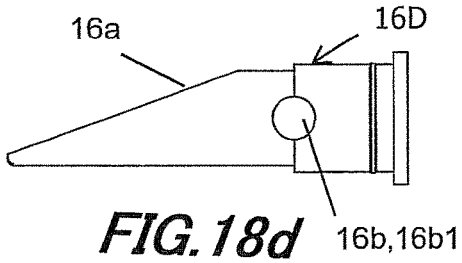
FIG. 18*d* is a side view of the spacer 16D.
Figure 18B:
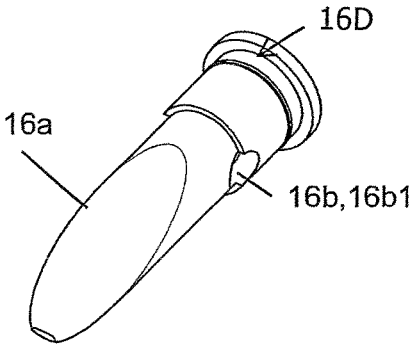
FIG. 18*b* is a perspective view of the spacer 16D, viewed from the front.
Figure 18E:
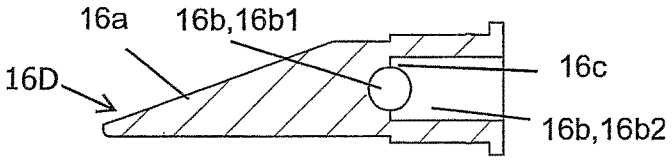
FIG. 18*e* is a sectional view, cut along a line I-II in FIG. 18*c;*
Figure 18F:
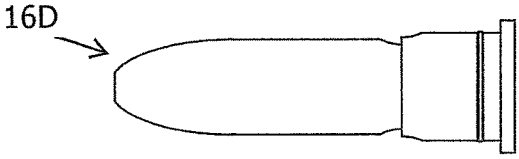
FIG. 18*f* is a backside view of the spacer 16D.
Figure 18G:
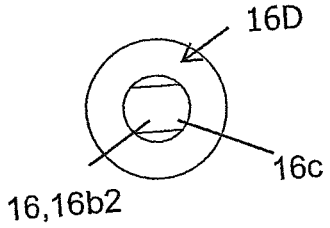
FIG. 18*g* is a view of the spacer 16D, viewed from the rear.
Figure 18H:
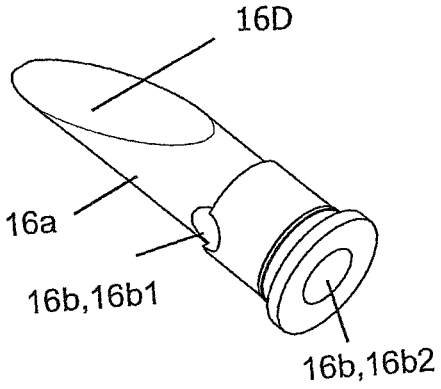
FIG. 18*h* is a perspective view of the spacer 16D, viewed from the rear.

As shown in FIG. 17A, a spacer 16C has a slope on the front end side of an exterior face 16*a*, the slope being formed to be flat without any step. A communication hole 16*b*1 having an opening is formed from the rear part of the slope. Similarly to the spacer 16A, a thick communication hole 16*b*2 is formed in the axial center on the rear side, extended forward and connected to the thin communication hole 16*b*1 at a stepped wall 16*c*, the communication hole 16*b*1 being opened on the slope. The other configurations are the same as those in the spacer 16A.

Similarly to the spacer 16B, as shown in FIG. 18, a spacer 16D has a slope on the front end side of an exterior face 16*a* but formed to be flat without any step. Further, similarly to the spacer 16B, openings of communication holes 16*b*1 are formed on both sides in the middle part of the spacer, instead of the slope, and connected to a communication hole 16*b*2 in the rear of the spacer via a stepped wall 16*c*. The other configurations are the same as those in the spacer 16B.

Similarly to the spacer 16D, as shown in FIG. 19, a spacer 16*a* formed to be flat without any step. However, differing from the spacer 16D and others, no communication hole is formed while communication grooves 40 for flowing the application liquid are formed on both sides.

Each communication groove 40 extends from the cutout in the flange on the rear side to the front side so as to be able to lead the application liquid to the flat exterior face 16*a*. The other configurations are the same as those in the spacer 16D.

Similarly to the spacer 16B, a spacer 16F has a slope on the front end side of an exterior face 16*a*, part of the slope being projected one step higher forming a spacer-side projected area 36, as shown in FIG. 20. Similarly to the spacer 16B, the spacer 16F has communication holes 16*b*1 each having an opening formed on both sides in the middle part thereof, instead of the slope. However, differing from the spacer 16B, the shape of the opening of the communication hole is rectangular.

Further, a projection 42 for anti-rotation is formed in the flange at the rear end on the slope side. The other components are the same as those in the spacer 16B, so the same reference numerals are allotted.

Similarly to the spacer 16F, as shown in FIG. 21, a spacer 16G has a slope on the front end side of an exterior face 16*a*, part of the slope being projected one step higher forming a spacer-side projected area 36. The spacer 16G has communication holes 16*b*1 of rectangular shape openings formed on both sides.

Further, two projections 42 for anti-rotation are formed in the flange at the rear end, at positions corresponding to the positions of the openings of the communication holes 16*b*1. The other components are the same as those in the spacer 16F, so the same reference numerals are allotted.

The applicator of the embodiment 1 is configured as shown in FIG. 1 by attaching the spacer 16A (see FIG. 15) as the spacer 16 to the application body 14A (see FIG. 11) as the application body 14. In this applicator, as the application liquid is sent out by means of the liquid pressurizing mechanism 12, the application liquid passes through the communication hole 16*b*1 on the slope side of the exterior face 16*a* and reaches the clearance 32. Since the application liquid enters the clearance 32 from the upper side of the delivery port 14*b* (the far side from the delivery port 14*b*), the liquid is sent from the upper side to the steps forming the spacer-side projected area 36 as shown by the broken line in FIG. 1*e*. The spacer 16 and the application body 14 become closer to each other in the spacer-side projected area 36 surrounding the delivery port 14*b*, hence the clearance 32 is narrowed. Accordingly, the application liquid is delayed to be ejected from delivery port 14*b* due to flow resistance, so that the application liquid can fill the whole clearance 32 between the spacer 16 and the interior of the application body 14. Thus, the application liquid can be made to uniformly fill the interior of the application body 14 so that it is possible to achieve ejection of the liquid with improved appearances, without degrading the exterior appearance of the application body 14 due to remaining air bubbles.

The applicator of the embodiment 2 is configured as shown in FIG. 2 by attaching the spacer 16B (see FIG. 16) as the spacer 16 to the application body 14A (see FIG. 11) as the application body 14. In this applicator, as the application liquid is sent out by means of the liquid pressurizing mechanism 12, the application liquid passes through the communication holes 16*b*1 on both sides of the exterior face 16*a* of the spacer 16B and reaches both sides of the clearance 32. Since the application liquid enters the clearance 32 from the both sides, the liquid is easily branched into the upper and lower sides and sent to the clearance 32 as shown by the broken lines in FIG. 2*e*.

The spacer 16 and the application body 14 become closer in the area surrounding the delivery port 14*b* to each other in the spacer-side projected area 36 of the spacer 16B, hence the clearance 32 is narrowed to be a clearance 32*b*. Accordingly, the application liquid is delayed to be ejected from delivery port 14*b* due to flow resistance, so that the application liquid can fill the whole clearance 32 between the spacer 16 and the interior of the application body 14. The other operation and effect are the same as in the applicator of the embodiment 1.

The applicator of the embodiment 3 is configured as shown in FIG. 3 by attaching the spacer 16C (see FIG. 17) as the spacer 16 to the application body 14B (see FIG. 12) as the application body 14. In this applicator, as the application liquid is sent out by means of the liquid pressurizing mechanism 12, the application liquid passes through the communication hole 16*b*1 on the slope side of the exterior face 16*a* and reaches the clearance 32. Since the application liquid enters the clearance 32 from the upper side of the delivery port 14*b* (the far side from the delivery port 14*b*), the liquid is sent toward the step of the application body-side projected area 34, as shown by the broken line in FIG. 3*e*.

The spacer 16 and the application body 14 become closer to each other in the application body-side projected area 34 of the interior face 14*a* of the application body 14, hence the clearance 32 is narrowed in the surrounding area of the delivery port 14*b*. Accordingly, the application liquid is delayed to be ejected from delivery port 14*b* due to flow resistance, so that the application liquid can fill the whole clearance 32 between the spacer 16 and the interior of the application body 14. The other operation and effect are the same as in the applicator of the embodiment 1.

The applicator of the embodiment 4 is configured as shown in FIG. 4 by attaching the spacer 16D (see FIG. 18) as the spacer 16 to the application body 14B (see FIG. 12) as the application body 14. In this applicator, as the application liquid is sent out by means of the liquid pressurizing mechanism 12, the application liquid passes through the communication holes 16*b*1 on the sides of the exterior face 16*a* and reaches the clearance 32. Since the application liquid enters the clearance 32 from the both sides of the spacer 16, the liquid is easily branched into the upper and lower sides and sent to the clearance 32 as shown by the broken lines in FIG. 4*e*.

The spacer 16 and the application body 14 become closer to each other in the application body-side projected area 34 of the interior face 14*a* of the application body 14, hence the clearance 32 is narrowed in the surrounding area of the delivery port 14*b*. Accordingly, the application liquid is delayed to be ejected from delivery port 14*b* due to flow resistance, so that the application liquid can fill the whole clearance 32 between the spacer 16 and the interior of the application body 14. The other operation and effect are the same as in the applicator of the embodiment 3.

The applicator of the embodiment 5 is configured as shown in FIG. 5 by attaching the spacer 16C (see FIG. 17) as the spacer 16 to the application body 14A (see FIG. 11) as the application body 14. In this applicator, as the application liquid is sent out by means of the liquid pressurizing mechanism 12, the application liquid passes through the communication hole 16*b*1 on the slope side of the exterior face 16*a* and reaches the clearance 32. Since the application liquid enters the clearance 32 from the upper side of the delivery port 14*b* (the far side from the delivery port 14*b*), the liquid flows as shown by the broken line in FIG. 5*e* and can fill the clearance 32 between the spacer 16 and the interior of the application body 14.

The applicator of the embodiment 6 is configured as shown in FIG. 6 by attaching the spacer 16D (see FIG. 18) as the spacer 16 to the application body 14A (see FIG. 11) as the application body 14. In this applicator, as the application liquid is sent out by means of the liquid pressurizing mechanism 12, the application liquid passes through the communication holes 16*b*1 on the sides of the exterior face 16*a* and reaches the clearance 32. Since the application liquid enters the clearance 32 from the both sides, the liquid is branched into the upper and lower sides, entering the clearance 32 as shown by the broken lines in FIG. 6*e*. Thus, the application liquid can be made to fill the whole the clearance 32 between the spacer 16 and the interior of the application body 14, keeping good appearances. The other operation and effect are the same as in the applicator of the embodiment 5.

The applicator of the embodiment 7 is configured as shown in FIG. 7 by attaching the spacer 16E (see FIG. 19) as the spacer 16 to the application body 14A (see FIG. 11) as the application body 14. In this applicator, as the application liquid is sent out by means of the liquid pressurizing mechanism 12, the application liquid passes through the communication grooves 40 (FIGS. 19*a* to 19*d*, 19*g* and 19*h*) defined between the sides of the spacer 16 and the interior face 14*a* of application body 14, entering the clearance 32 via the front, upper and lower sides, as shown by the broken lines in FIG. 7*e*. Thus, the application liquid can be made to fill the whole the clearance 32 between the spacer 16 and the interior of the application body 14 from the left and right sides of the spacer 16, keeping good appearances.

The applicator of the embodiment 8 is configured as shown in FIG. 8 by attaching the spacer 16E (see FIG. 19) as the spacer 16 to the application body 14B (see FIG. 12) as the application body 14. In this applicator, as the application liquid is sent out by means of the liquid pressurizing mechanism 12, the application liquid passes through the communication grooves 40 defined between the sides of the spacer 16 and the interior face 14*a* of application body 14, entering the clearance 32. Thus, the application liquid passes through the clearance 32 as shown by the broken lines in FIG. 8*e*.

The spacer 16 and the application body 14 become closer to each other in the application body-side projected area 34 of the interior face 14*a* of the application body 14, hence the clearance 32 is narrowed in the surrounding area of the delivery port 14*b*. Accordingly, the application liquid is delayed to be ejected from delivery port 14*b* due to flow resistance, so that the application liquid can fill the whole clearance 32 between the spacer 16 and the interior of the application body 14. The other operation and effect are the same as in the applicator of the embodiment 3.

The applicator of the embodiment 9 is configured as shown in FIG. 9 by attaching the spacer 16F (see FIG. 20) as the spacer 16 to the application body 14C (see FIG. 13) as the application body 14. In this applicator, as the application liquid is sent out by means of the liquid pressurizing mechanism 12, the application liquid passes through the communication grooves 40 defined between the sides of the spacer 16 and the interior face 14*a* of application body 14, entering the clearance 32. Thus, the application liquid passes through the clearance 32 as shown by the broken lines in FIG. 9*e*.

The spacer 16 and the application body 14 become closer to each other in the spacer-side projected area 36 of the spacer 16F, hence the clearance 32 is narrowed in the surrounding area of the delivery port 14*b*. Accordingly, the application liquid is delayed to be ejected from delivery port 14*b* due to flow resistance, so that the application liquid can fill the whole clearance 32 between the spacer 16 and the interior of the application body 14.

With the spacer 16F, the projection 42 (FIGS. 20*a* to 20*d* and 20*h*) fits to the anti-rotation indentation 38 (FIGS. 13*b* to 13*c*, 13*e*, 13*g* and 13*h*) of the application body 14C so as to stabilize the application body without causing any rotation during usage.

The applicator of the embodiment 10 is configured as shown in FIG. 10 by attaching the spacer 16G (see FIG. 21) as the spacer 16 to the application body 14D (see FIG. 14) as the application body 14. The application liquid flows through the clearance 32 as shown by the broken lines in FIG. 10*e*. In this applicator, two projections 42 (FIGS. 21*a* to 21*d*, FIGS. 20*f* and 20*h*) fit into two anti-rotation indentations 38 (FIGS. 14*b* to 14*d*, 14*e*, 14*g* and 14*h*) of the application body C so as to prevent the application body 14*d* from a rotation and keep the application body 14D more stably during use than in embodiment 9. The other operation and effect are the same as in the embodiment 9.

As has been described heretofore, according to the applicators of the embodiments 1 to 10, since spacer 16 is provided inside application body 14, this arrangement markedly contributes to reducing the volume of the space inside the application body 14 and suppressing liquid residue.

Further, depending on the position of the delivery port 14*b* in the application body 14, there is a risk that liquid unfilled part is formed in the clearance 32 between the application body 14 and the spacer 16, spoiling appearances due to generation of air bubbles. To deal with this, according to the applicators of the embodiments 1 to 4, 9 and 10, for the clearance 32 around the delivery port 14*b*, the application body-side projected area 34 or the spacer-side projected area 36 is formed in the vicinity of the deliver port 14*b* on the interior face of the application body 14 or the exterior of the spacer 16 each of which is facing the clearance 32, so as to form a narrower clearance than the other part of the clearance 32. By this arrangement, it is possible to delay ejection of liquid by the flow resistance of the application liquid arising from the narrowed clearance, whereby the application liquid can be fully or completely spread inside the application body, without generating air bubbles.

Accordingly, filling the interior of the application body 14 with the application liquid makes it possible to achieve ejection of the liquid without degrading the exterior appearance of the application body due to remaining air bubbles.

In this case, it is more preferable that the application body 14 is made transparent or translucent so as to make the interior application liquid visible, whereby the interior of the application body 14 can be externally observed and fully confirmed.

Here, the present invention should not be limited to the above configurations of the embodiments, but various modifications and changes can be made within the scope of the present invention. For example, the application body may be formed in a tapered shape other than the sloped configuration; a plurality of delivery openings may be formed; and a clicking type liquid pressurizing mechanism may be adopted.

INDUSTRIAL APPLICABILITY

The liquid applicator of the present invention is most suitably used for makeup applicators for directly applying application liquids for lip rouge, cheek rouge, eyeshadow, etc., to the human skin. Other than these, the liquid applicator of the present invention can be used for the applicators for chemical products for applying fluid chemicals, and for the applicators for applying application liquids such as adhesives, paints, etc., to the object. Further, as the application liquid, low-viscosity or high-viscosity cosmetics may be used. A high-viscosity cosmetic, for example, a cheek cream or other high internal water phase water-in-oil emulsified cosmetics can be applied and spread thin and broadly without the need of skill, hence the applicator can be favorably used for foundation, lotion, skincare, etc.

DESCRIPTION OF REFERENCE NUMERALS

12 liquid pressurizing mechanism
14 application body
14*a* interior face of application body
14*b* delivery port
16 spacer
16*a* exterior face of spacer
16*b*1, 16*b*2 communication hole of spacer
32 clearance
32*b* clearance
34 application body-side projected area
36 spacer-side projected area
38 anti-rotation indentation for application body
40 communication groove of spacer
42 projection of spacer

What is claimed is:

1. An applicator for feeding an application liquid from a source of liquid to a delivery port to an outside by way of an interior space of an application body, comprising:

an application body having an interior space of a first dimension defined by an interior surface; and, a spacer inserted in said interior space of the application body, said spacer having an exterior surface of a second dimension smaller than said first dimension such that, when inserted into said interior space a clearance is provided between said exterior surface of the spacer having said second dimension and said interior surface of the application body having said first dimension forming a communication passage for flowing an application liquid, and a gap is maintained between said spacer and said delivery port whereby said delivery port is not closed by said spacer, further comprising a second passage through said spacer within the portion thereof defined by said second dimension for receiving fluid from said source of fluid and providing said fluid to said communication passage, wherein the application liquid is delivered from a delivery port of the application body by way of the second passage and the communication passage.

2. The applicator according to claim 1, wherein a projected area is formed in a vicinity of the delivery port on one of the exterior face of the spacer and the interior face of the application body, facing the clearance, whereby the clearance in the vicinity of the delivery port is made narrower than the clearance in areas other than the vicinity of the delivery port.

3. The applicator according to claim 2, wherein the application body is formed to be transparent or translucent so as to make the application liquid in the interior space visible.

4. The applicator according to claim 3, wherein the second passage comprises a hole in said spacer within the portion thereof defined by said second dimension for connecting the clearance with the source of liquid, and an opening of the hole in the spacer is provided respectively on both sides of said spacer.

5. The applicator according to claim 3, further comprising an indentation formed in one of a rear end of the spacer and a rear end of the application body and a projection formed in the other thereof so that the projection and the indentation are engaged to prevent rotation of said spacer.

6. The applicator according to claim 2, wherein the second passage comprises a hole in said spacer within the portion thereof defined by said second dimension for connecting the clearance with the source of liquid, and an opening of the hole in the spacer is provided respectively on both sides of said spacer.

7. The applicator according to claim 2, further comprising an indentation formed in one of a rear end of the spacer and a rear end of the application body and a projection formed in the other thereof so that the projection and the indentation are engaged to prevent rotation of said spacer.

8. The applicator according to claim 1, wherein the application body is formed to be transparent or translucent so as to make the application liquid in the interior space visible.

9. The applicator according to claim 8, wherein the second passage comprises a hole in said spacer within the portion thereof defined by said second dimension for connecting the clearance with the source of liquid, and an opening of the hole in the spacer is provided respectively on both sides of said spacer.

10. The applicator according to claim 8, further comprising an indentation formed in one of a rear end of the spacer and a rear end of the application body and a projection formed in the other thereof so that the projection and the indentation are engaged to prevent rotation of said spacer.

11. The applicator according to claim 1, wherein the second passage comprises a hole in said spacer within the portion thereof defined by said second dimension for connecting the clearance with the source of liquid, and an opening of the hole in the spacer is provided respectively on both sides of said spacer.

12. The applicator according to claim 11, further comprising an indentation formed in one of a rear end of the spacer and a rear end of the application body and a projection formed in the other thereof so that the projection and the indentation are engaged to prevent rotation of said spacer.

13. The applicator according to claim 1, further comprising an indentation formed in one of a rear end of the spacer and a rear end of the application body and a projection formed in the other thereof so that the projection and the indentation are engaged to prevent rotation of said spacer.

* * * * *